US010648164B2

(12) United States Patent
Yamasaki et al.

(10) Patent No.: US 10,648,164 B2
(45) Date of Patent: May 12, 2020

(54) FLUSH TOILET

(75) Inventors: Yu Yamasaki, Fukuoka (JP); Kenji Watanabe, Fukuoka (JP); Masaaki Inoue, Fukuoka (JP); Masahiro Nakamura, Fukuoka (JP)

(73) Assignee: TOTO LTD., Fukuoka (JP)

( * ) Notice: Subject to any disclaimer, the term of this patent is extended or adjusted under 35 U.S.C. 154(b) by 387 days.

(21) Appl. No.: 13/588,566

(22) Filed: Aug. 17, 2012

(65) Prior Publication Data

US 2013/0047328 A1 Feb. 28, 2013

(30) Foreign Application Priority Data

Aug. 24, 2011 (JP) ..... 2011-182898
Aug. 24, 2011 (JP) ..... 2011-182900

(51) Int. Cl.
*E03D 11/02* (2006.01)
*E03D 11/08* (2006.01)

(52) U.S. Cl.
CPC ..... *E03D 11/02* (2013.01); *E03D 11/08* (2013.01)

(58) Field of Classification Search
CPC ..... E03D 11/02; E03D 11/08; E03D 11/18; E03D 2201/30; E03D 2201/40
USPC .... 4/420, 421, 425, 345, 422–424, 426–442
See application file for complete search history.

(56) References Cited

U.S. PATENT DOCUMENTS 5,918,325 A 7/1999 Arita et al.
6,145,138 A 11/2000 Nakamura et al.
7,661,153 B2 * 2/2010 Nakamura et al. ..... 4/420
7,827,628 B2 * 11/2010 Ichiki et al. ..... 4/420
8,151,379 B2 * 4/2012 Mueller et al. ..... 4/420
2004/0040080 A1 * 3/2004 Prokopenko et al. ..... 4/420
2006/0005310 A1 1/2006 Nakamura et al.
2007/0061955 A1 * 3/2007 Asada et al. ..... 4/425

FOREIGN PATENT DOCUMENTS

CA 2163149 A1 5/1997
DE 92 16 494 U1 1/1993
EP 0 392 997 A2 10/1990
GB 935949 A 9/1963
GB 2 431 937 A 5/2007
JP 2000-265525 A 9/2000
(Continued)

OTHER PUBLICATIONS

JP 2001279788_Translation.*
(Continued)

*Primary Examiner* — David P Angwin
*Assistant Examiner* — William R Klotz
(74) *Attorney, Agent, or Firm* — Studebaker & Brackett PC

(57) ABSTRACT

A flush toilet comprises a bowl portion including a rim portion and a shelf portion; a water discharge path for discharging waste; a water spouting portion for spouting flush water onto the shelf portion of the bowl portion to form a swirl flow; and a water conduit for supplying the flush water to the water spouting portion; wherein the bowl portion includes a front region and a rear region, and the rim portion of the bowl portion is such that a curvature radius in the front region is equal to or smaller than a curvature radius of the rear region, and wherein the water spouting portion is formed on either a left or right side in the front region and spouts the flush water toward a front of the rim portion.

14 Claims, 12 Drawing Sheets

(56) References Cited

FOREIGN PATENT DOCUMENTS

| | | | | |
|---|---|---|---|---|
| JP | 2001-271407 | A | | 10/2001 |
| JP | 2001-279791 | A | | 10/2001 |
| JP | 2001279788 | A | * | 10/2001 |
| JP | 2005-098003 | A | | 4/2005 |
| JP | 2007-169964 | A | | 7/2007 |
| JP | 2007-314975 | A | | 12/2007 |
| JP | 2007314975 | A | * | 12/2007 |
| JP | 2010-255316 | A | | 11/2010 |
| TW | I247838 | B | | 1/2006 |
| WO | 98/16696 | A1 | | 4/1998 |

OTHER PUBLICATIONS

JP 2007314975_Translation.*

JP2000265525A (1) Translation.*

An Office Action; "Notice of Reason for Rejection," issued by the Japanese Patent Office dated Feb. 19, 2014, which corresponds to Japanese Patent Application No. 2011-182898 and is related to U.S. Appl. No. 13/588,566.

The extended European Search Report dated Dec. 21, 2012, which corresponds to EP Application No. 12179751.8-2315 and is related to U.S. Appl. No. 13/588,566.

Communication pursuant to Article 94(3) EPC issued by the European Patent Office dated Apr. 13, 2016, which corresponds to European Patent Application No. 12179751.8-1608 and is related to U.S. Appl. No. 13/588,566.

An Office Action issued by the Taiwanese Patent Office dated Sep. 9, 2016, which corresponds to Taiwanese Patent Application No. 101108303 and is related to U.S. Appl. No. 13/588,566; with English language comments.

An Office Action issued by the Indian Patent Office dated Mar. 27, 2019, which corresponds to Indian Patent Application No. 2593/DEL/2012 and is related to U.S. Appl. No. 13/588,566; with English language translation.

A Search Report and a Written Opinion issued by the Brazilian Patent Office dated Sep. 16, 2019 (Publication of these documents made in Official Gazette No. 2542, of Sep. 24, 2019), which corresponds to Brazilian Patent Application No. BR102012021111-4 and is related to U.S. Appl. No. 13/588,566; with English language translation.

* cited by examiner

FLUSH TOILET

TECHNICAL FIELD

The present invention relates to a flush toilet, and in particular to a flush toilet for discharging waste using flush water supplied from a flush water supply source.

BACKGROUND ART

As shown in Japanese patent unexamined publication 2010-255316 (patent document 1), a conventional toilet for discharging waste by flushing the toilet with flush water is known. In the conventional toilet, a water spouting port is disposed in one location at an intermediate or rear position in the front-rear direction of the bowl portion in order to clean the comparatively easily dirtied rear surface portion of the toilet bowl portion interior, and the direction of the water spouting port is set so that after passing the rear surface portion of the bowl portion, the flush water spouted from the water spouting port swirls toward the front surface portion of the bowl portion.

Also, another toilet is known in which, as shown in Japanese patent unexamined publication 2000-265525 (patent document 2), a water outlet port is provided on either the left or right side within the front region of the toilet bowl portion interior, and the direction of spout water from this spout water port is directed rearward so that the rear surface portion of the bowl portion is cleaned.

Moreover, as shown in Japanese patent unexamined publication 2007-314975 (patent document 3), a flush toilet is also known in which a water spouting port is disposed at the front end part within the toilet bowl portion, and flush water is spouted toward the rear surface portion of the bowl portion.

Further, as shown in Japanese patent unexamined publication 2005-98003 (patent document 4), a flush toilet for discharging waste by flushing the toilet with flush water is known. In the toilet, the inner circumference of the rim portion formed on the top edge of the bowl portion of the flush toilet is formed in a shape which broadens vertically or toward the outside, such that flush water is spouted horizontally from rim spout ports formed on the rear side of the rim portion to form a swirling flow, and water is also spouted toward the discharge trap from a jet spout port disposed below and on the front end of the bowl portion to produce a siphon effect, thereby discharging waste.

Furthermore, as shown in Japanese patent unexamined publication 2007-169964 (patent document 5), a flush toilet is known. In the flush toilet, regarding the front and rear regions of the rim portion formed to spread outward at the top edge of the bowl portion, each forms the same arc shape with a fixed curvature radius, and a shelf return portion protruding inward on the toilet, which is a means for preventing the splashing of flush water to the outside of the toilet, is provided in the front region of the rim portion in the vicinity of the side portion formed in a straight line shape between the water spouting port at the rear side of the toilet and the front region of the rim portion.

SUMMARY OF THE INVENTION

Technical Problem

However, in the conventional flush toilets set forth in the above-described patent documents 1 through 3, while cleaning performance relative to cleaning the comparatively easily dirtied rear surface portion within the toilet bowl portion is improved, the flow force of the flush water spouted from the water spouting port after it cleans the rear surface portion of the bowl portion, swirls to the front surface portion of the bowl portion, and then reaches the front surface portion of the bowl portion, is in a weakened state compared to the flow force of the flush water when it passes the rear surface portion of the bowl portion. Moreover, the effect of a bowl portion shape in which the curvature radius of the front surface portion of the bowl portion is equal to or smaller than the curvature radius of the rear surface portion of the bowl portion is that the flow of flush water seeking to pass over the front surface portion also has greater energy losses compared to that occurring when passing over the rear surface portion of the bowl portion, creating the problem of poor cleaning of the bowl portion front portion due to insufficient swirling of the flush water at the front surface portion of the bowl portion. In particular, with the trend toward low flush water use in recent years, the amount of flush water used to clean the interior the bowl portion has been dramatically reduced, making the problem of insufficient cleaning due to insufficient swirling of flush water inside the bowl portion one which must be urgently overcome.

On the other hand, in the flush toilet set forth in the above-described patent document 4, the inner circumference of the rim portion formed on the top edge of the bowl portion is formed in a shape which broadens vertically or outward, and there are numerous locations at which the curvature radius of the inner circumferential surface of the rim portion changes over the entire perimeter of the inner circumferential surface of the rim portion, therefore the problem arises that flush water spouted from these rim spouting ports can pass over the rim portion and splash outside the toilet when flowing as it swirls along the rim portion.

Moreover, in the flush toilet swirl flow in the above-described patent document 5, notwithstanding that when it passes through the arc-shaped front region of the rim portion and moves from the straight line-shaped side portion to the arc-shaped rear region, the flow of flush water spouted from the spout ports on the rear side of the toilet may not be able to move smoothly along the path of the rim portion water conduit, and that in the rear region of the rim portion it has an essentially vertical shape, the problem arises that flush water may splash outside the toilet because the above-described shelf return portion is not provided.

It is therefore an object of the present invention to provide a flush toilet capable of preventing poor cleaning caused by insufficient swirling of flush water, and of reliably cleaning the toilet.

It is another object of the present invention to provide a flush toilet capable of preventing flush water flowing in the rim portion from splashing outside the toilet.

Solution to Problem

The above object is achieved according to the present invention by providing a flush toilet for discharging waste using flush water supplied from a flush water source, the flush toilet comprising a bowl portion provided with a bowl-shaped waste receiving surface, a rim portion formed on the top edge portion thereof, and a shelf portion formed between the rim portion and the waste receiving surface; a water discharge path for discharging waste, the path including an inlet which is connected at the bottom of the bowl portion; a water spouting portion for spouting flush water onto the bowl portion shelf portion to form a swirl flow; and a water conduit for supplying flush water to the spouting portion; wherein the bowl portion includes a front region and a rear region; and the rim portion of the bowl portion is such that the curvature radius in the front region is equal to or smaller than the curvature radius of the rear region; and wherein the water spouting portion is formed on either the left side or the right side in the front region of the rim portion and spouts the flush water toward the front of the rim portion so that the spouted flush water swirls from the front region of the rim portion via the front end to the rear region.

In the present invention thus constituted, a water spouting portion is formed on either the left side or the right side in the front region of the rim portion, flush water is spouted toward the front of the rim portion, and after passing from the front region of the rim portion via the front end, this spouted flush water swirls to the rear region; therefore since flush water with some flow force, having been spouted from the water spouting portion, first passes over the front end of the small curvature radius rim portion, the problem whereby flush water cannot swirl and cleaning is insufficient can be also prevented in the front region of the rim portion. Moreover, because flush water can swirl up to the rear region of the rim portion while maintaining a comparatively strong flow force, the easily dirtied rear region of the bowl portion can also be reliably cleaned.

In the present invention, the bowl portion is preferably formed so that the front end of the rim portion has the smallest curvature radius of the entire perimeter of the rim portion, and the water spouting portion is formed to be behind the front end of the rim portion within the front region.

In the present invention thus constituted, the water spouting portion is formed to be behind the front end of the rim portion within the front region, which is formed at a minimum curvature radius, therefore flush water spouted from the water spouting portion, after passing the front end of the rim portion while maintaining a comparatively strong flow force, can circulate to the rear region of the rim portion, thereby preventing the problem whereby flush water cannot swirl to the front end of a rim portion having a minimum curvature radius, such that cleaning is poor. Since flush water can swirl to the rear region of the rim portion while maintaining a comparatively strong flow force, the easily dirtied rear region of the bowl portion can also be reliably cleaned.

In the present invention, within the front region of the rim portion of the bowl portion, the water spouting portion is preferably formed on a part which is adjacent to either the left side or the right side of the front end of the rim portion and which changes from a large curvature radius to a small curvature radius.

In the present invention thus constituted, the water spouting portion is formed into a part which, within the front region of the rim portion of the bowl portion, is adjacent to either the left side or the right side of the front end of the rim portion and changes from a large curvature radius to a small curvature radius, therefore flush water spouted from the water spouting portion immediately reaches the front end of the rim portion maintaining a strong flow force such that it can subsequently swirl to the rear region of the rim portion, thereby preventing the problem whereby flush water cannot swirl at the front end of the minimum curvature radius rim portion so that cleaning is poor. Also, since flush water can swirl up to the rear region of the rim portion while sufficiently maintaining a comparatively strong flow force, the easily dirtied rear region of the bowl portion can also be more reliably cleaned.

In the present invention, the bowl portion is preferably such that the majority of the rear region of the rim portion forms a true circle having a predetermined radius.

In the present invention thus constituted, the majority of the rear region of the rim portion of the bowl portion forms a true circle having a predetermined radius, therefore since the curvature radius does not change in the majority of the rear region of the rim portion of the bowl portion, loss of energy in the flush water passing through the rear region of the rim portion can be suppressed, and flush water can be made to more reliably swirl. Also, since [flush water] can swirl to the rear region of the rim portion while maintaining a comparatively strong flow force, the easily dirtied rear region of the bowl portion can also be reliably cleaned.

In the present invention, the rim portion of the bowl portion is preferably such that inner circumferential surface thereof is formed to have an inwardly overhanging shape in the vicinity of the front end of the rim portion, and is formed to have an approximately vertically rising shape outside the region of the front end of the rim portion.

In the present invention thus constituted, the inner circumferential surface of the rim portion of the bowl portion is formed to have an inwardly overhanging shape in the vicinity of the front end of the rim portion, and is formed to have an approximately vertically rising shape outside the region of the front end of the rim portion, therefore water splashing outside the toilet does not occur in the front end region of the minimum curvature radius rim portion, thus enabling an increase in flow force of flush water spouted from the water spouting portion. As a result, in the front region of the rim portion where the curvature radius is small, non-circulation of flush water and poor cleaning can be prevented. Also, since flush water can circulate up to the rear region of the rim portion while sufficiently maintaining a comparatively strong flow force, the easily dirtied rear region of the bowl portion can also be more reliably cleaned. Moreover, since the inner circumferential surface of the bowl portion rim portion is formed to rise approximately vertically in the region of the front end, any waste which may adhere there can be easily removed, and sanitation is improved.

In the present invention, the water spouting portion is preferably formed on the top end side of the rim portion of the bowl portion.

In the present invention thus constituted, the water spouting portion is formed on the top end side of the rim portion of the bowl portion, therefore flush water spouted from the water spouting portion at a comparatively high position on the rim portion forms a flow whereby it passes over the front end region of the small curvature radius rim portion and swirls to the rear side of the rim portion (swirling flow), and also forms a flow whereby it falls from the top edge side of the rim portion (falling flow), therefore a broad range of the inner circumferential surface of the overhang shape formed at the front end vicinity of the rim portion of the bowl portion, which is most prone to dirtying, can be reliably cleaned by these swirling and falling flows.

In the present invention, the water spouting portion is preferably provided with a water spouting port, and the top surface of the water spouting port and the overhang-shaped portion of the inner circumferential surface of the rim portion are continuously formed.

In the present invention thus constituted, the top surface of the water spouting port and the overhang-shaped portion of the inner circumferential surface of the rim portion are continuously formed, therefore flush water spouted from the water spouting port of the water spouting portion located at a high position disposed on the top edge side relative to the rim portion can flow smoothly along the inner circumferential surface of the rim portion, and a swirling flow and falling flow passing over the front end region of the small curvature radius rim portion are formed, so that a broad range of the inner circumferential surface of the overhang shape formed in the vicinity of the front end of the rim portion of the bowl portion, which is most prone to dirtying, can be reliably cleaned.

In the present invention the water spouting portion is preferably such that its water spouting port rim portion is tilted from bottom to top toward the direction in which water is spouted.

In the present invention thus constituted, the rim portion of the water spouting port on the water spouting portion is tilted from bottom to top toward the direction in which water is spouted, therefore flush water spouted from the water spouting port on the water spouting portion is formed by the port rim portion tilted from bottom to top into a flow (swirling flow) passing over the front end region of the small curvature radius rim portion and swirling to the rear side of the rim portion, and flowing downward (downward flow) from the top edge side of the rim portion; the front end vicinity of the rim portion of the bowl portion can thus be reliably cleaned by these circulating and downward flows.

The above object is also achieved according to the present invention by providing a flush toilet for discharging waste using flush water supplied from a flush water supply source, the flush toilet comprises: a bowl portion including a bowl-shaped waste receiving surface, a rim portion formed on the top edge portion thereof, the inner circumferential surface of which is formed to rise essentially vertically, and a shelf portion formed between the rim portion and the waste receiving surface; a water discharge path for discharging waste, the path including an inlet which is connected to the bottom of the bowl portion; a water spout portion for spouting flush water onto the shelf of the bowl portion to form a swirling flow; and a water conduit for supplying flush water to the water spout portion; wherein the water spout portion is formed in the vicinity of the front end within the front region of the rim portion, the rear region of the rim portion is formed to have a curvature radius larger than that of the front end of the front region of the rim portion and essentially fixed in left-right symmetry, and the water spout portion spouts water toward the front of the rim portion so that the spouted flush water swirls from the front region of the rim portion via the front end to the rear region.

In the present invention thus constituted, flush water spouted toward the front from the water spout portion formed in the vicinity of the front end within the front region of the rim portion passes through the front end within the front region of the rim portion and flows smoothly while maintaining spouting force into the rear region, in which the curvature radius is larger than that of the front end of the rim portion; furthermore the rear region of the rim portion is formed in a left-right symmetrical essentially fixed curvature radius, therefore flush water can be caused to swirl by taking advantage of the centrifugal force acting on the flush water, without reducing the force of the spout water. As a result, flush water flowing in the rim portion can be prevented from splashing outside the toilet, and a broad sweep of the bowl interior can be flushed with comparatively strong force, even when the inner circumferential surface of the rim portion is formed in an essentially vertically standing shape.

In the present invention, the bowl portion rim portion is preferably provided in the front region with a region proximate to the front end vicinity, formed to have a larger curvature radius than the curvature radius of the rear region.

In the present invention thus constituted, the bowl portion rim portion is provided within the front region with a region proximate to the front end vicinity formed to have a larger curvature radius than the curvature radius of the rear region, therefore flush water spouted from the water spout portion and passing the front end of the rim portion flows to the region proximate to the vicinity of the front end within the front region of the rim portion of the bowl portion maintaining a comparatively strong flow force. By flowing in a region proximate to the front end vicinity within the front region of the rim portion, formed to have a larger curvature radius than the curvature radius of the rear region of the rim portion, this flush water flows smoothly to the rear region of the rim portion in a stable state while maintaining the comparatively strong flow force of the flush water from the front region of the rim portion, therefore splashing outside the toilet by flush water flowing in the rim portion can be prevented even if the inner circumferential surface of the rim portion has a shape rising in essentially a vertical direction.

In the present invention, the front end within the front region of the rim portion is preferably formed using the smallest curvature radius of the entire circumference of the rim portion, and the rim spout portion is formed on a part which is adjacent to either the left side or the right side of the front end of the rim portion and which changes from a large curvature radius to a small curvature radius.

In the present invention thus constituted, the flow force of flush water spouted from the water spout portion at a strong flow force toward the front end within the front region of the rim portion is moderately suppressed by the moderate energy loss incurred when it passes through front end within the front region of the rim portion formed using the smallest curvature radius, therefore splashing of flush water outside the toilet due to over-strong flow force can be prevented.

In the present invention, the rim portion of the bowl portion is preferably formed in an overhang shape in which the top edge portion protrudes inward in the part from the rim spout portion to the front end vicinity within the front region of the rim portion.

In the present invention thus constituted, the top edge portion in the part particularly prone to splashing, from the rim spout portion to the front end within the front region of the rim portion having the smallest curvature radius, is formed in an overhanging shape protruding inward, therefore even if by some chance flush water swirling in the rim portion splashes up in the part from the water spout portion up to the front end within the front region of the rim portion, this splash up hits the overhang-shaped top edge portion of rim portion, therefore splashing outside of the toilet can be prevented.

Advantageous Effects of the Invention

According to the flush toilet of the present invention, poor cleaning caused by insufficient swirling of flush water can be prevented, assuring reliable toilet cleaning.

Further, according to the flush toilet of the present invention, flush water flowing in the rim portion can be prevented from splashing outside the toilet.

BRIEF DESCRIPTION OF DRAWINGS

FIG. 17(*b*) shows the results of an analysis of flow rate distribution for jet spout water and the appearance of the flow when a toilet is flushed using a conventional flush toilet, as a comparison example relative to the analytic results shown in FIG. 17(*a*).

DESCRIPTION OF EMBODIMENTS

Referring to the attached drawings, a flush toilet according to an embodiment of the present invention will be described.

Figure 1:
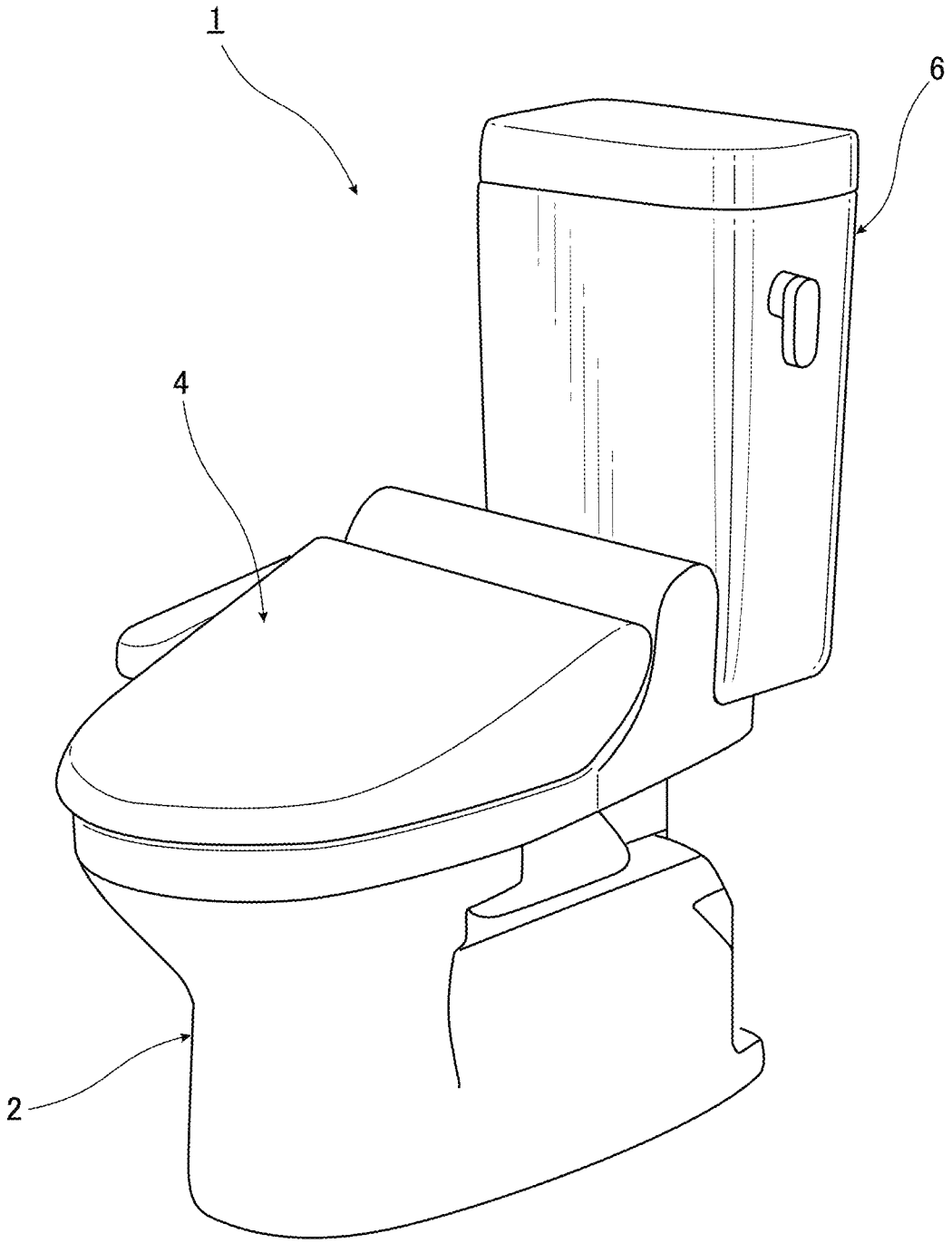
FIG. 1 is a schematic perspective view showing a flush toilet according to an embodiment of the present invention.

FIG. 1 is a schematic perspective view showing the toilet seat on a flush toilet according to an embodiment of the present invention.

As shown in FIG. 1, the flush toilet 1 according to an embodiment of the present invention is what is known as a wash-down type flush toilet in which waste is washed away by the flow action created by water dropping within the bowl portion; it is provided with a ceramic toilet main unit 2, a toilet lid 4 covering a toilet seat (not shown) disposed on the upper surface of the toilet main unit 2, and a gravity feed reservoir tank 6 serving as flush water source, for storing flush water used in toilet flushing and for supplying water to the toilet main unit 2.

Note that with respect to the flush water source supplying flush water to the toilet main unit 2, there is no limitation to a tank-type apparatus such as the gravity fed reservoir tank 6 shown in this embodiment; flush water may also be supplied by a water main direct pressure system directly utilizing water main supply pressure, or by a flush valve, or by pump assisted pressure, etc.

Figure 2:
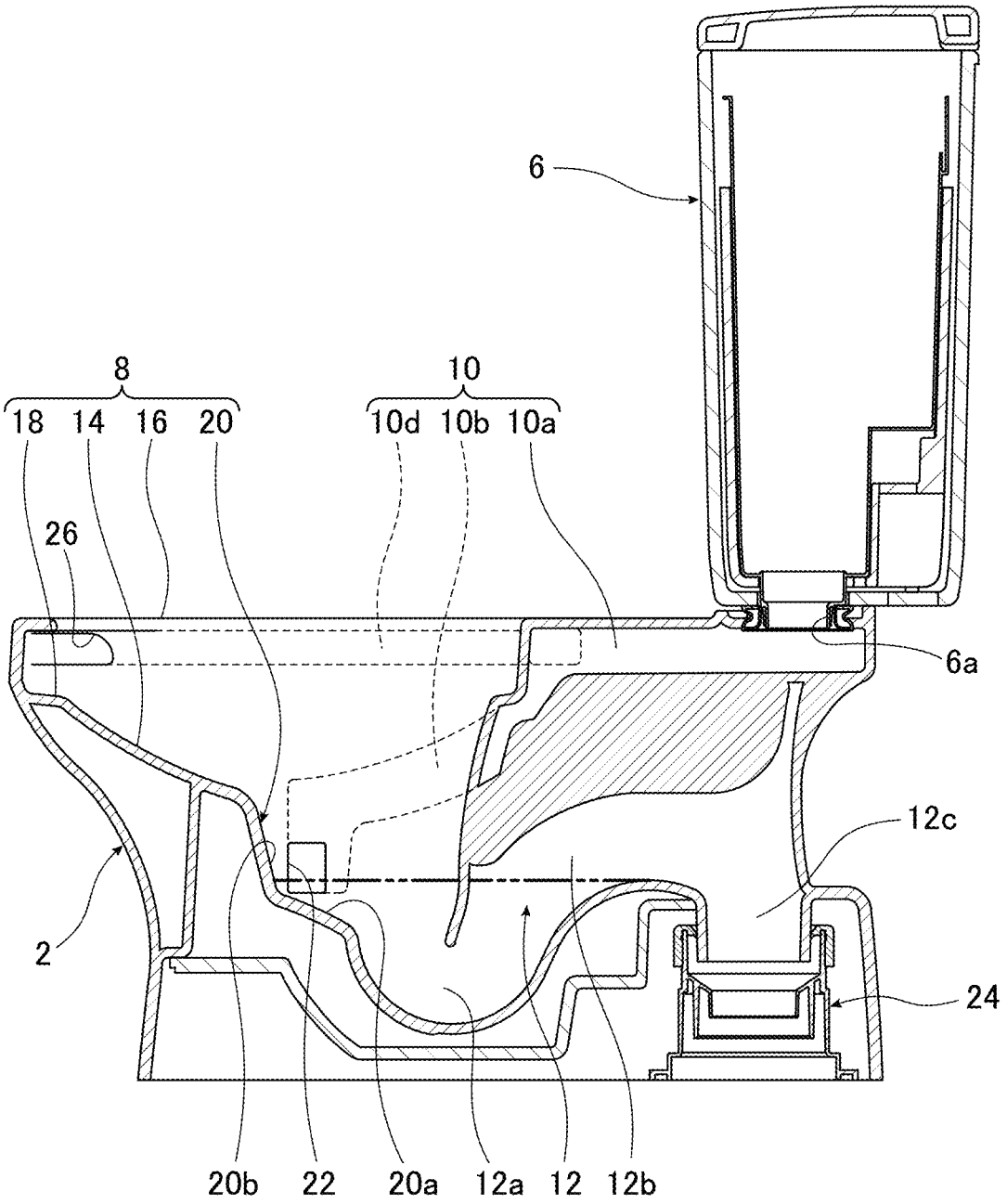
FIG. 2 is a side view in which the toilet seat and toilet cover are omitted in a flush toilet according to an embodiment of the present invention.
Figure 3:
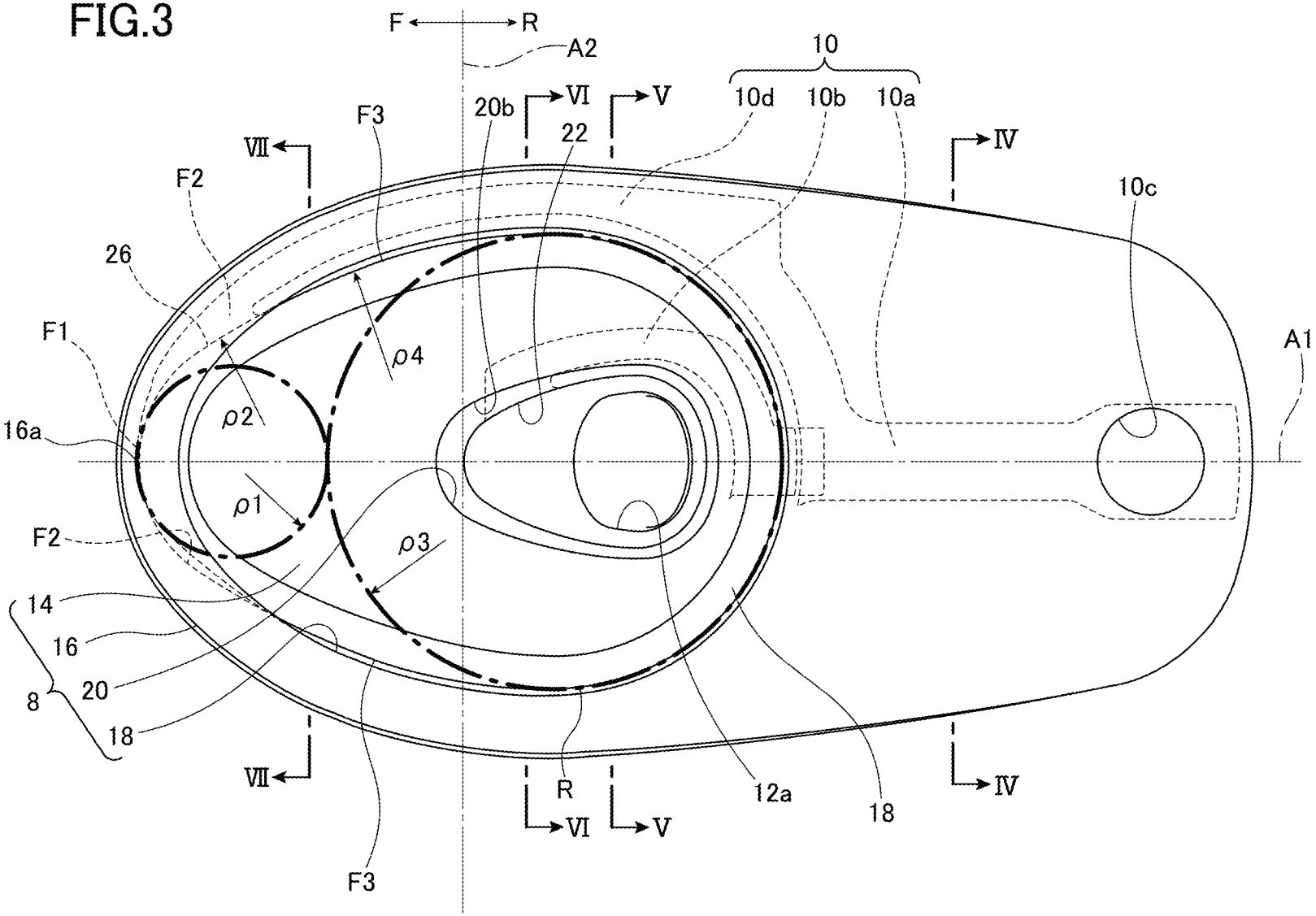
FIG. 3 is a plan view showing the main toilet unit of a flush toilet according to an embodiment of the present invention.
Figure 4:
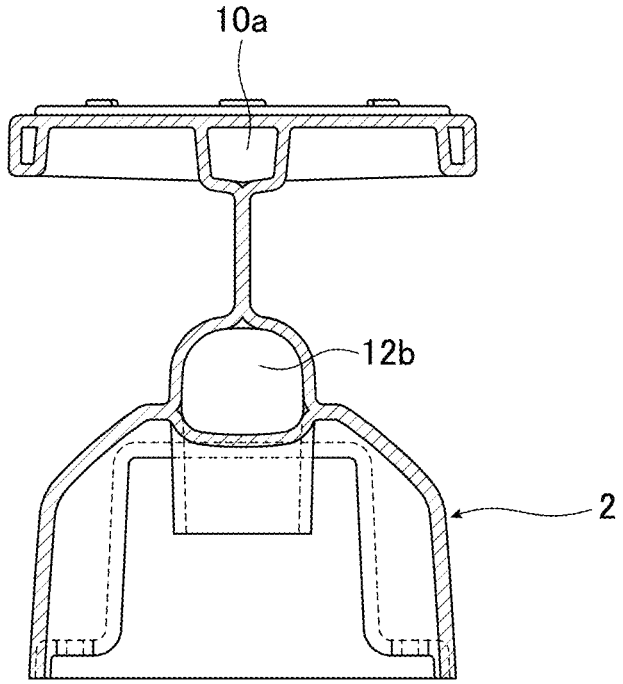
FIG. 4 is a cross sectional view seen along line IV-IV in FIG. 3.
Figure 5:
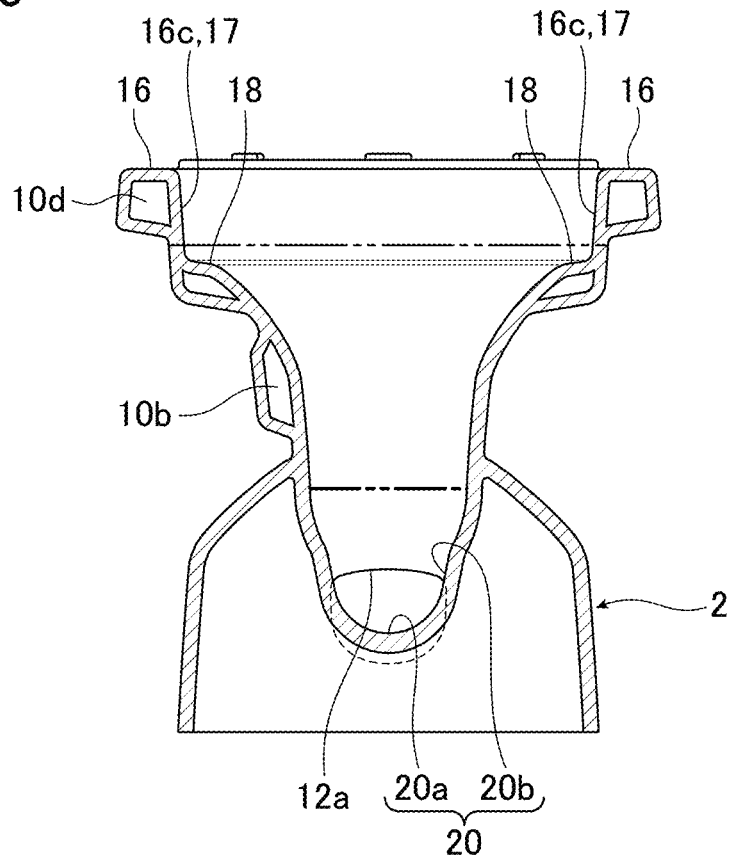
FIG. 5 is a cross sectional view seen along line V-V in FIG. 3.

FIG. 2 is a side view in which the toilet seat and toilet cover are omitted from a flush toilet according to an embodiment of the present invention; FIG. 3 is a plan view showing a flush toilet according to an embodiment of the present invention.

As shown in FIGS. 2 and 3, a bowl portion 8 is formed at the front top portion of the toilet main unit 2. Also, a water conduit 10 for spouting flush water supplied from the reservoir tank 6 to the bowl portion 8 is formed at the rear top portion of the toilet main unit 2.

In addition, a water discharge trap pipe 12 serving as a discharge path for discharging waste inside the bowl portion 8 is formed at the bottom of the bowl portion 8.

The bowl portion 8 is provided with a bowl-shaped waste receiving surface 14, a rim portion 16 formed along the top edge portion of the bowl portion 8, and a shelf portion 18 formed between this waste receiving surface 14 and the rim portion 16.

The bowl portion 8 is provided with a concave portion 20 formed in a region below the waste receiving surface 14 and connected to the water discharge trap pipe 12; this concave portion 20 is provided with a bottom surface 20*a* and a wall surface 20*b* connecting the bottom surface 20*a* and the bottom edge portion 14*a* of the waste receiving surface 14.

In addition, seen from the front side of the toilet main unit 2 with respect to center line A1 (see FIG. 3) which equally divides the bowl portion 8 in the left-right direction, a jet water spouting port 22 is formed on the side wall surface 20*b* at the left side of the concave portion 20; this jet water spouting port 22 is connected from the shared water conduit 10*a* on the water conduit 10, described in detail below, to the branched jet water conduit 10*b*, and the main flow of the flush water spouted from the jet water spouting port 22 circulates within the concave portion 20. Thus when flush water is spouted from the jet water spouting port 22 it becomes difficult for accumulated water in the concave portion 20 of the bowl portion 8 to spread outward by the swirling flow f4 of the jet water spout, and floating waste can be gathered at approximately the center of the water accumulated in the concave portion 20 and reliably discharged. In addition, water splash-ups produced by the swirling, downward flow, and collision of rim spout water spouted from the rim spouting port 26 described below can be more effectively suppressed when flush water seeks to splash out of the bowl portion 8 concave portion 20.

An inlet port 12*a* on the above-described water discharge trap pipe 12 opens at the back and rear of the concave portion 20 of the waste receiving surface 14 of the bowl portion 8; a rise path 12*b* extends rearward from this inlet port 12*a*. A fall path 12*c* connects to this rise path 12*b*; the bottom end of this fall path 12*c* is connected to an underfloor discharge pipe (not shown) via a discharge socket 24.

Note that in the flush toilet 1 of the present embodiment, one example of a floor discharge-type flush toilet in which the bottom end of the fall path 12*c* on a water discharge trap pipe 12 is connected to an underfloor discharge pipe (not shown) is described, but the flush toilet is not limited to this form, and may also be applied to an above-floor discharge-type flush toilet in which the end of the fall path 12*c* is disposed on the rear wall side of the flush toilet and is connected to an above-floor discharge pipe.

Next, referring to FIGS. 2 through 8, details of the water conduit 10 on flush toilet 1 are described.

Figure 8:
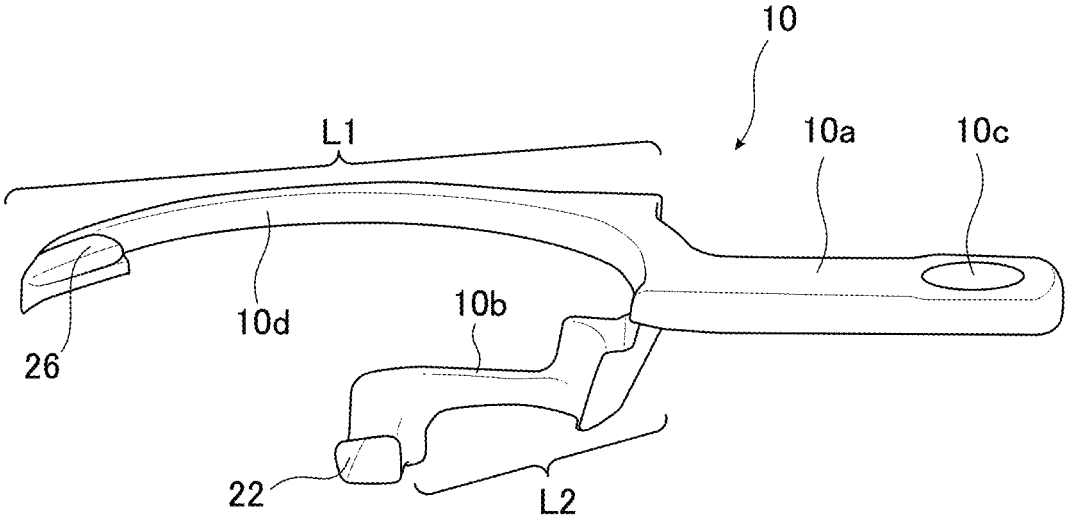
FIG. 8 is a perspective view showing the water conduit in a flush toilet according to an embodiment of the present invention.

FIGS. 4 through 7 are respectively cross sectional views seen along lines IV-IV, V-V, VI-VI, and VII-VII in FIG. 3; FIG. 8 is a perspective view showing the overall water conduit in a flush toilet according to an embodiment of the present invention.

As shown in FIGS. 2 through 8, the water conduit 10 is provided with: a shared water conduit 10*a* extending from the inlet portion 10*c* connected to the discharge port 6*a* on the reservoir tank 6 to the vicinity of the back surface side of the bowl portion 8, and a jet water conduit 10*b* and rim water conduit 10*d* respectively branching from the water conduit 10*a* in the vicinity of the back surface side of the bowl portion 8.

The rim water conduit 10*d* branches from the shared water conduit 10*a* in the vicinity of the back surface of the bowl portion 8, extending toward the front along the interior of the rim portion 16 positioned on the left side as seen from the front side of the toilet main unit 2 relative to the center line A1 (see FIG. 3) which equally divides the bowl portion 8 in the left-right direction, and extends up to a single rim spouting port 26 (described in detail below) disposed on the left side as seen from the front side of the toilet main unit 2 within the front region F of the rim portion 16.

The jet water conduit 10*b* branches from the shared water conduit 10*a* in the vicinity of the back side of the bowl portion 8, extending forward so as to circumvent the outside of the left side wall surface 20*b* of the concave portion 20 of the bowl portion 8 seen from the front side of the toilet main unit 2 relative to the center line A1 (see FIG. 3) which equally divides the bowl portion 8 in the left-right direction, then extending up to the jet water spouting port 22 formed on the left side wall surface 20*b* of the concave portion 20. When the bowl portion 8 is respectively equally divided in the front-back and left-right directions, the jet water spouting port 22 is disposed on the rear side relative to the rim spouting port 26 on the rim portion 16, and on the left side when seen from the front of the bowl portion 8.

Note that it is sufficient for the rim spouting port 26 and the jet water spouting port 22 to be formed on the same side on either the left or the right of the bowl portion 8.

By forming the rim spouting port 26 on the front side of the jet water spouting port 22, even if splashing outside of the concave portion 20 of the bowl portion 8 by the swirl flow (referred to below as "diagonal swirl flow f4") of flush water spouted from the jet water spouting port 22 occurs, it can be restrained by the force of the swirl flow (referred to below as "swirl flow f5") spouted from the rim spouting port 26.

Furthermore, the route length L1 of the rim water conduit 10*d* is set to be longer than the route length L2 of the jet water conduit 10*b* as a means of setting the timing of water spouting so that jet spouting of flush water conducted to the jet water spouting port 22 through the jet water conduit 10*b* from the shared water conduit 10*a* begins prior to commencing rim spouting of flush water conducted to the rim spouting port 26 through the rim water conduit 10*d* from the shared water conduit 10*a*. This form of setting permits air present in the shared water conduit 10*a* at the time of flush start to be evacuated from the jet water spouting port 22 via the jet water conduit 10*b*, so that air discharged from the rim spouting port 26 when water spouting at the rim spouting port 26 begins can be reduced using a simple structure. The popping sound and splash-up produced when air, having flowed from the shared water conduit 10*a* into the rim water conduit 10*d* together with flush water, is compressed within the rim water conduit 10*d* and discharged from the rim spouting port 26 can be prevented, as can the splashing of water to outside the toilet 1.

Also, even if water splash-up occurs when air compressed within the jet water conduit 10*b* is discharged together with flush water at the jet water spouting port 22, the jet water spouting port 22 is positioned at the bottom in the bowl portion 8—i.e. on the side wall surface 20*b* of the concave portion 20 between the waste receiving surface 14 and the water discharge trap pipe 12, therefore water splashing outside of the toilet 1 can be prevented.

Furthermore, even if the air present within the shared water conduit 10*a* when flushing begins mixes in with flush water flowing from the shared water conduit 10*a* to the rim water conduit 10*d*, a rim spouting port 26 is formed on the front region F of the bowl portion 8, so that the rim water conduit 10*d* forms a comparatively long path from the shared water conduit 10*a* in the vicinity of the back surface of the bowl portion 8 to the rim spouting port 26, and air becomes sufficiently diffused as it flows through the rim water conduit 10*d* that the poping sound and water splash-up produced when water is spouted from the rim spouting port 26 can be suppressed.

Note that in the present embodiment, it is explained as an example of a means for starting jet water spouting before the start of rim water spouting a form whereby the route length L1 of the rim water conduit 10*d* is set to be longer than the route length L2 of the jet water conduit 10*b*, but the present invention is not limited to this form, and it is also acceptable to set the respective flow rates and volumes within the rim water conduit and the jet water conduit so that jet water spouting is started before the start of rim water spouting.

It is also acceptable to provide a pipe member communicating with the shared water conduit 10*a* and the interior of the concave portion 20 in place of the jet water conduit 10*b* as a way of evacuating air inside the shared water conduit 10*a*.

Next, referring to FIG. 3, FIGS. 5 through 7, and FIGS. 9 through 11, details of a rim portion 16, a shelf portion 18 and a rim spouting port 26 of the bowl portion 8 of the flush toilet 1 are described.

Figure 9:
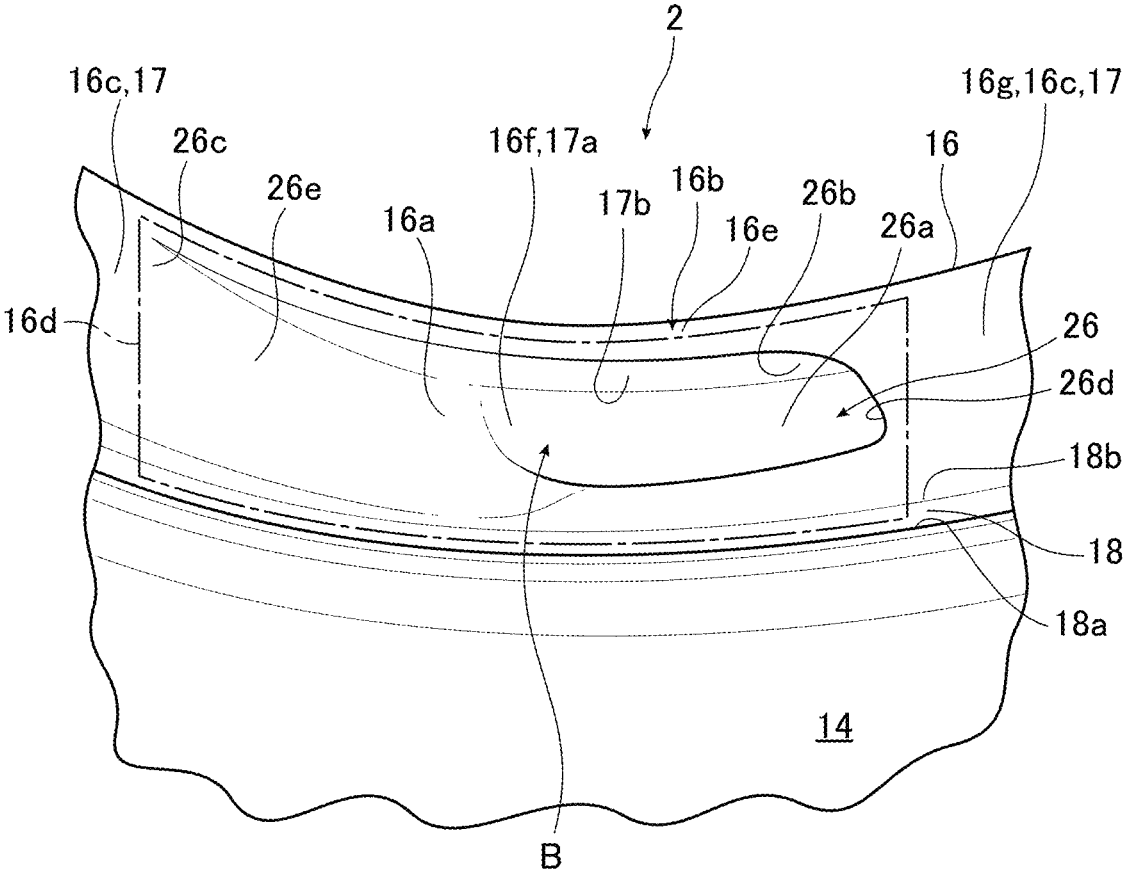
FIG. 9 is an enlarged perspective view in which the rim water spouting port in the front region within the bowl portion of a flush toilet according to an embodiment of the present invention is viewed diagonally from below looking from the rear side.
Figure 10:
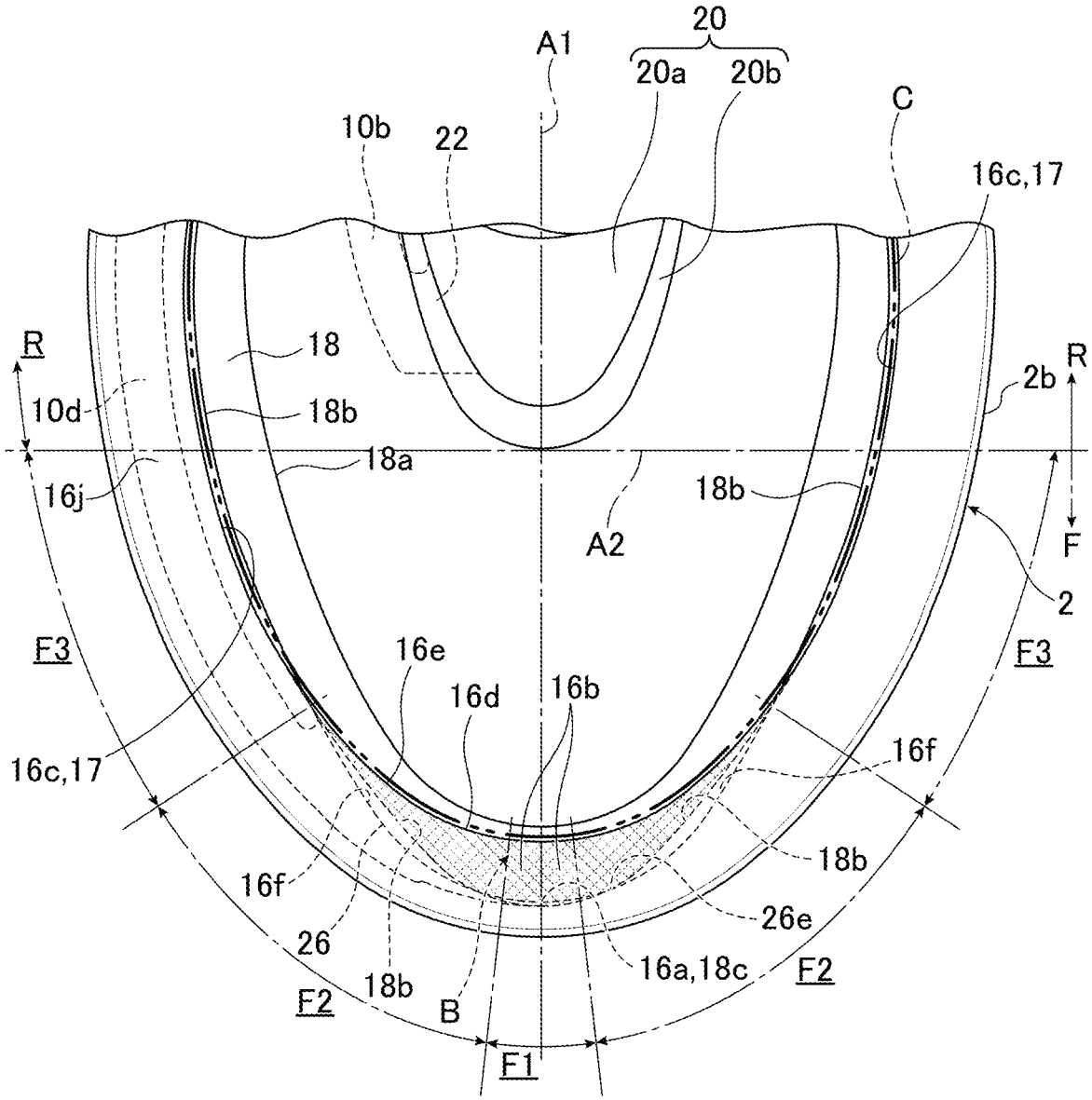
FIG. 10 is a partial enlarged plan view in which the front part of a flush toilet according to the embodiment of the present invention shown in FIG. 3 is enlarged.
Figure 11:
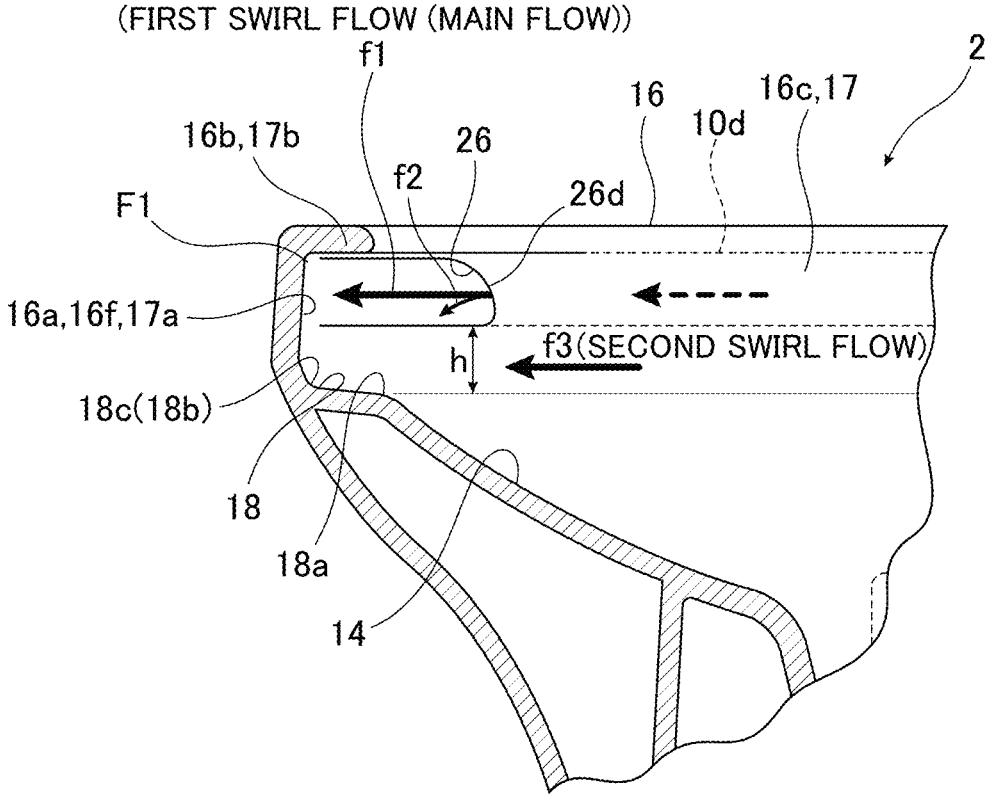
FIG. 11 is a partial enlarged plan view in which the rim water spouting portion of a flush toilet according to the embodiment of the present invention shown in FIG. 3 is enlarged.

FIG. 9 is an enlarged perspective view of the rim spouting port in the front region within the bowl portion of a flush toilet according to an embodiment of the present invention as seen from the diagonally below on the rear side; FIG. 10 is a partial enlarged plan view zoomed in on the front part of the flush toilet according to the embodiment of the present invention shown in FIG. 3; FIG. 11 is a partial enlarged perspective view zoomed in on the rim spouting port part of a flush toilet according to the embodiment of the present invention shown in FIG. 2.

As shown in FIGS. 3 and 10, the bowl portion 8 is provided with a front region F and a rear region R, which are equal divisions of the bowl portion 8 created by the center line A2 (see FIG. 3) extending in the left-right direction of the bowl portion 8.

The front region F of the bowl portion 8 is provided with a region F1 which is disposed symmetrically relative to the center line A1 and the front end portion 16*a* (the inner circumferential front end portion 16*a*) of the inner circumferential surface 17 of the rim portion 16, and includes the front end portion 16*a*, a region F2 positioned behind the region F1, and a region F3 positioned yet further behind this region F2.

The front end portion 16*a* within the front region F1 of the rim portion 16 has the smallest curvature radius ρ1 within the entire perimeter of the rim portion 16; the rim spouting port 26 is formed within the front region F2 positioned behind the front end portion 16*a* within the front region F1 of the rim portion 16, and flush water is spouted toward this front end portion 16*a*.

In other words, the rim spouting port 26 is disposed in the vicinity of the minimum curvature radius portion positioned at the front end portion 16*a* of the rim portion 16, and by spouting flush water toward this minimum curvature radius portion, the water spouting direction vector and the water flow force of the flush water spouted from the rim spouting port 26 can be stabilized so that after passing through the front end portion 16*a* of the rim portion 16 while maintaining a comparatively high water flow force, flush water can swirl to the rear region R of the rim portion 16. By so doing, the easily dirtied rear region R of the bowl portion 8 can be properly washed, and since the flush water continues to swirl with its flow force maintained after passing through the rear region R, a situation is prevented whereby cleaning is poor due to an inability to also swirl in the vicinity of the rim portion 16 front end portion 16*a*.

Flush water spouted from the rim spouting port 26 makes a first circulation swirl along the rim portion 16 after passing the smallest curvature radius portion of the front end portion 16*a* of the rim portion 16, but the flow of flush water flowing down from the rim spouting port 26 to the shelf portion 18 is suppressed by the effect of centrifugal force acting on the outer side of the rim portion 16 when passing the smallest curvature radius portion of this rim portion 16, therefore a collision with the swirling flow on the shelf portion 18 can be restrained when the first circulation swirl has ended and the second circulation swirl is seeking to begin.

In addition, the rim spouting port 26 is adjacent on the left side as seen from the front side of the toilet main unit 2 relative to the front end portion 16*a* within the front region F1 of the bowl portion 8 rim portion 16, and is formed within the front region F2, which is the part in which the curvature radius ρ2 changes from a large curvature radius to a small curvature radius from the rear toward the front. Flush water spouted from the rim spouting port 26 thus immediately reaches the front end portion 16*a* on the rim portion 16 with a strong flow force maintained, and can thereafter swirl to the rear region R of the rim portion 16, thus preventing a situation in which cleaning is poor due to an inability to swirl in the vicinity of the smallest curvature radius front end portion 16*a* of the rim portion 16. Moreover, a moderate energy loss arising when flush water spouted from the rim spouting port 26 at a strong flow force toward the front end portion 16*a* in the front region F1 of the rim portion 16 passes over the front end within the front region F1 of the rim portion 16 formed at the minimum curvature radius ρ1 results in moderate restraint of flow force so that splashing of flush water outside the toilet due to over-strong flow force can be prevented.

Also, the majority of the rear region R of the rim portion 16 of the bowl portion 8 forms a portion (an arc shape) of a true circle having a fixed radius (curvature radius ρ3). Therefore since the curvature radius ρ3 (the radius of the circle) does not change in the majority of the rear region R of the rim portion 16 of the bowl portion 8, loss of energy in the flush water when passing over rear region R of the rim portion 16 can be restrained, and flush water can be made to more reliably swirl, such that swirling occurs with a comparatively strong flow force maintained up to the rim portion 16 rear region R, and the rear region R of the bowl portion 8, which is easily-dirtied, can be reliably cleaned. Also, since the majority of the rear region R of the rim portion 16 of the bowl portion 8 forms a portion of a true circle of a predetermined radius (curvature radius ρ3), the majority of the rear region R of the rim portion 16 of the bowl portion 8 which is most prominent when seen by a user from diagonally forward and above forms a portion of a true circle with a predetermined radius (curvature radius ρ3), thereby improving the aesthetic appeal of the entire bowl portion 8.

Within the front region F, the rim portion 16 of the bowl portion 8 is provided with a front region F3 formed at a curvature radius ρ4, equal to the curvature radius ρ2 and larger than the curvature radius ρ3 ($\rho 4=\rho 2>\rho 3$); this front region F3 is disposed to be closely proximate to the vicinity of the front end portion 16*a* within the front region F1 between the front region F2 and the rear region R. Thus flush water which has passed from the rim spouting port 26 through the front end portion 16*a* of the rim portion 16 passes through the front region F2 proximate to the vicinity of the front end portion 16*a* in the front region F1 of the bowl portion 8 rim portion 16 and maintains a comparatively strong flow force as it flows into the front region F3. By flowing through the front region F3 of the rim portion 16 formed with a curvature radius ρ4, which is larger than the curvature radius ρ3 of the rear region R of the rim portion 16, this flush water is able to flow smoothly to the rear region R of the rim portion 16, maintaining in a stable state the flow force of the flush water from front regions F1 and F2, which is comparatively stronger than that of the front region F3, so that even if the inner circumferential surface 17 of the rim portion 16 has a shape rising essentially vertically, splashing to the outside of the flush toilet 1 by flush water flowing in the rim portion 16 can be prevented.

Note that in this embodiment, it is explained the form in which the curvature radius ρ1 in the front region F1 of the rim portion 16 is set to be smaller than the curvature radius ρ3 of the rear region R of the rim portion 16, but the flush toilet is not limited to this form, and it is also acceptable to set the curvature radius ρ1 of the front region F1 of the rim portion 16 to be equal to the curvature radius ρ3 of the rear region R of the rim portion 16. Alternatively, it is also acceptable to set any one of the curvature radii ρ1, ρ2, or ρ4 of the front regions F1, F2, and F3 of the rim portion 16 to be equal to the curvature radius ρ3 of the rear region R of the rim portion 16.

The bowl portion 8 rim portion 16 is provided with an overhanging part 16*b*, formed in a shape such that the top edge portion from the rim spouting port 26 in the front region F2 facing toward the front side up to the vicinity of the front end portion 16*a* within the front region F1 of the rim portion 16 protrudes locally inward, and the top of the rim spouting port 26 is covered by this overhanging part 16*b*.

The rim portion 16 of the bowl portion 8 is provided with a rising portion 16*c* shaped to rise in an appropriate vertical direction in the region of the inner circumferential surface 17 outside the overhanging part 16*b*.

Thus an inward-facing overhang shape is formed by the overhanging part 16*b* in the front regions F1 and F2 around the front end portion 16*a* of the inner circumferential surface 17 of the rim portion 16, and in the front region F3 and rear region R outside the vicinity of the rim portion 16 front end portion 16*a*, is formed into an approximately vertical rising shape, so that in the vicinity of the smallest curvature radius ρ1 front end portion 16*a* of the rim portion 16, there is no splashing of water outside the flush toilet 1, and the flow force of flush water spouted from the rim spouting port 26 can be increased. Also, since flush water can swirl up to the rear region R of the rim portion 16 while sufficiently maintaining a comparatively strong flow force, the easily dirtied rear region of the bowl portion 8 can also be more reliably cleaned.

Also, because of the overhanging part 16*b* in the front regions F1 and F2 in the vicinity of the front end portion 16*a* of the rim portion 16, even if splash-up occurs near the rim spouting port 26 of the rim portion 16 where it is particularly prone to occur, that splash-up hits the top edge portion of the overhanging part 16*b* on the rim portion 16, therefore splashing outside the toilet 1 can be prevented.

In addition, since the inner circumferential surface 17 of the bowl portion 8 rim portion 16 is formed to rise approximately vertically in the region of the front end, any waste which may adhere there can be easily removed, and sanitation improved.

Note that in the flush toilet 1 of the present embodiment, it is explained as an example a form in which the inner circumferential surface 17 of the rim portion 16 is provided with a rising portion 16*c*, but as an alternative to this rising portion 16*c*, this could also be set to an overhang shape over essentially the entire perimeter of the inner circumferential surface of the rim portion, or could be what is known as the open rim type, in which the inside of a rim water conduit formed along the circumferential direction of the rim portion 16 is left open.

The rim spouting port 26 is positioned by a predetermined distance h above the height position of the shelf portion 18 of the bowl portion 8, and is formed at the top end side of the rim portion 16 of the bowl portion 8. Thus flush water spouted from the rim spouting port 26 forms a flow (swirl flow f1) which passes the vicinity of the front end portion 16*a* of the rim portion 16 where the curvature radius is small and swirls to the rear side of the rim portion 16, forming a falling flow (falling flow f2) from the top end side of the rim portion 16; the interior of the bowl portion 8 can thus be effectively cleaned by this swirl flow f1 and falling flow f2. The flush water spouted from the rim spouting port 26, which is in a comparatively high position disposed at the top end side of the rim portion 16, enables reliable cleaning around the front end portion 16*a* of the rim portion 16 of the bowl portion 8.

Moreover, by forming the rim spouting port 26 on the rim portion 16 at a predetermined distance h above the shelf portion 18, flush water spouted from the rim spouting port 26 swirls, as will be described in detail below using FIGS. 14 and 15, without the swirl flow f1 of the first circulation first swirl trajectory T1 flowing down on the shelf portion 18; the second circulation second swirl trajectory T2 swirl flow f3 swirls on the shelf portion 18, and in the vicinity of the rim spouting port 26 where splashing is particularly prone to occur, splash-up caused by the collision between flush water swirling around the rim portion 16 in the first circulation first swirl trajectory T1 and the second circulation second swirl trajectory T2 can be suppressed.

In addition, because the rim spouting port 26 is formed at the top end side of the rim portion 16 of the bowl portion 8, the rim spouting port 26 reliably falls into the blind angle of the overhanging part 16*b* of the rim portion 16 from the standpoint of a user looking at the bowl portion 8 from diagonally forward and above, making it more difficult for the user to see the rim spouting port 26. Furthermore, in addition to improving the sense of cleanliness perceived by the user, the overall aesthetic appeal of the bowl portion 8 can also be improved.

Moreover, the rim spouting port 26 is formed on the rim portion 16, which is positioned further outside (on the outside portion 18*b* side of the shelf portion 18) than the inner edge portion 18*a* of the shelf portion 18 of the bowl portion 8, and as will be described in detail below using FIGS. 14 and 15, in plan view the first swirl trajectory T1 is positioned outside of the second swirl trajectory T2. Thus in the vicinity of the rim spouting port 26 where splashing is particularly prone to occur, splash-up caused by collision between the flush water in the first swirl trajectory T1 and the second swirl trajectory T2 can be effectively suppressed.

Also, the rim portion 16 on the bowl portion 8 is provided with a continuously formed portion 26*c*, continuously formed from a top edge portion 26*b* forming the top surface of a water passageway 26*a* formed within the rim spouting port 26, facing downstream to the rising portion 16*c* on the inner circumferential surface 17 of the rim portion 16; this continuously formed portion 26*c* is positioned on the inner circumferential surface 17 of the rim portion 16 to the right of the center line A1 (see FIG. 3) as seen from the front side of the toilet main unit 2. The rim portion 16 overhanging part 16*b* is continuously formed on the top surface of the rim spouting port 26 by such a continuously formed portion 26*c*, therefore flush water spouted from the rim spouting port 26 flows smoothly along the inner circumferential surface 17 of the rim portion 16. Because of the formation of the swirl flow f1 and falling flow f2, which pass near the front end portion 16*a* of the small curvature radius rim portion 16, the vicinity of the front end portion 16*a* of the rim portion 16 of the bowl portion 8 can be reliably cleaned. In addition, the continuous formation of the top edge portion 26*b* forming the top surface of the water passageway 26*a* forming rim spouting port 26, and of the inner circumferential surface 17 of the rim portion 16, enables flush water spouted from the rim spouting port 26 to flow smoothly along the inner circumferential surface 17 of the rim portion 16 by centrifugal force, so that splash-ups produced by the collision of separate swirling flush waters can be suppressed.

The overhanging part 16*b* in the front regions F1 and F2 of the rim portion 16 extend from the rim spouting port 26 toward the front side to the front end portion 16*a* within the front region F1 of the rim portion 16, and from this front end portion 16*a* to the continuously formed portion 26*c*; seen from above, the bowl portion 8 is symmetrically left-right disposed relative to the front end portion 16*a* of the rim portion 16. The rim spouting port 26 is thus formed in the vicinity of the front end portion 16*a* of the rim portion 16, and the overhanging part 16*b* of the rim portion 16 covers the rim spouting port 26, so that viewed by user from diagonally forward and above, the rim spouting port 26 cannot be observed. Furthermore, the overhanging part 16*b* of the rim portion 16 is formed to be left-right symmetrical in the vicinity of the front end portion 16*a* of the rim portion 16 of the bowl portion 8, thus enabling the overall aesthetic appeal of the bowl portion 8 to be improved.

Also, facing in the direction of spouting from the rim spouting port 26*a*, the perimeter portion 26*d* on the rear side of the rim spouting port 26 is tilted from bottom to top. Flush water spouted from the rim spouting port 26 by means of the perimeter portion 26*d* of the rim spouting port 26 tilted from bottom to top thus forms a flow (swirl flow f1) passing the vicinity of the front end portion 16*a* of the small curvature radius rim portion 16 and swirling toward the rear side of the rim portion 16, and forms a falling flow (falling flow f2) from the top end side of the rim portion 16; the front end portion 16*a* of the rim portion 16 of the bowl portion 8 can thus be effectively cleaned by this swirl flow f1 and falling flow f2.

The incline from bottom to the top of the rim spouting port 26 perimeter portion 26*d* in the direction of water spouting thus enables flush water spouted from the rim spouting port 26 to flow downward even if an uncleaned portion is created at the boundary between the first swirl trajectory T1 and the second swirl trajectory T2, thereby preventing the occurrence of such uncleaned portions.

Additionally, part of the flush water spouted from the rim spouting port 26 can be made to drop by the rim spouting port 26 perimeter portion 26*d* inclined from the bottom to the top in this water spouting direction, and this falling flush water allows more effective suppression of the tendency for splashing to the outside by the swirl flow f4 spouted from the jet water spouting port 22. In the concave portion 20 of the bowl portion 8, the addition of rim spout water falling in this way to water spouted from the jet water spouting port 22 results in the creation of a swirl flow f4 provided with a strong rotational force in which the horizontal swirl flow and the vertical swirl flow are combined, thereby raising waste discharge performance. Moreover, splash-ups arising when rim spout water and jet spout water collide can also be more effectively suppressed.

The bowl portion 8 rim portion 16 is formed to be left-right symmetrical in the rear region R and front region F3, etc. within the bowl portion 8 visible to the user when the bowl portion 8 is viewed diagonally from forward and above; the inside circumference of the rim spouting port 26 is open but the top is covered by the overhanging part 16*b*, so is not visible to a user looking at the rim portion 16 diagonally from forward and above the bowl portion 8, and the overall aesthetic appeal of the bowl portion 8 can thus be improved.

In particular, as shown in FIGS. 9 through 11, the rim spouting port 26 is formed in the vicinity of the front end portion 16*a* of the rim portion 16 of the bowl portion 8, and the inner circumferential surface 17 in the front region F1 of the rim portion 16 is formed into an overhang shape in the vicinity of the front end portion 16*a* of the rim portion 16 by a vertical surface 17*a* and a horizontal surface 17*b* extending inward from this vertical surface 17*a*. A forward protruding concave space B is formed on the shelf portion 18 in the vicinity of the front end portion 16*a* of the rim portion 16 by this vertical surface 17*a* and horizontal surface 17*b*, and within this concave space B the rim spouting port 26 and the vertical surface 17*a* of the rim portion 16 are continuous so as to be flush.

I.e., in the bowl portion 8 rim portion 16 front regions F1 and F2, the rim spouting port 26 is formed within an indented space B, formed so as to protrude forward of and by a predetermined width to the left and right relative to a virtual surface 16*d*, which is flush with the inner circumferential surface 17 forming the rising portion 16*c* rising essentially vertically in the rear region R and front region F3 of the rim portion 16 of the bowl portion 8. The top edge portion of this concave space B matches the overhanging part 16*b*, and the bottom end of the front end portion 16*a* of the inner circumference surface 16*f* in the concave space B matches the front end 18*c* of the outside portion 18*b* of the shelf portion 18.

The rim spouting port 26 is positioned forward of the rear edge 16*e* of the top edge portion 16*b* of indented space B and behind the front end 18*c* of the outside edge portion 18*b* of the shelf portion 18; a water passageway 26*a* extending from the rear end of the rim spouting port 26 perimeter portion 26*d* along the inner circumference surface 16*f* within the indented space B up to the vicinity of the front end portion 16*a* is formed within the indented space B, and the extended part 26*e* extending from this water passageway 26*a* through the front most portion 16*a* of the inner circumference surface 16*f* within the indented space B is continuously formed from within the indented space B to the continuously formed portion 26*c* of the rim portion inner circumferential surface 16*c*. It is thus difficult for users viewing the bowl portion 8 diagonally from forward and above to see the rim spouting port 26, and the sense of cleanliness perceived by the user can thus be improved.

Furthermore, although discussed in detail below using FIGS. 14 and 15, the direction in which flush water spouted from the rim spouting port 26 swirls and the direction in which flush water spouted from the jet water spouting port 22 swirls are the same direction when seen in plan view. The water spouting direction D1 in the jet water spouting port 22 (arrow D1 in FIG. 14) is diagonally downward facing the front, and is essentially the same as the water spouting direction D2 in the rim spouting port 26 (arrow D2 in FIG. 14).

Next, referring to FIGS. 6, 10, 12, and 13, an adhesive step when manufacturing a ceramic flush toilet 1 according to an embodiment of the present invention is described.

Figure 12:
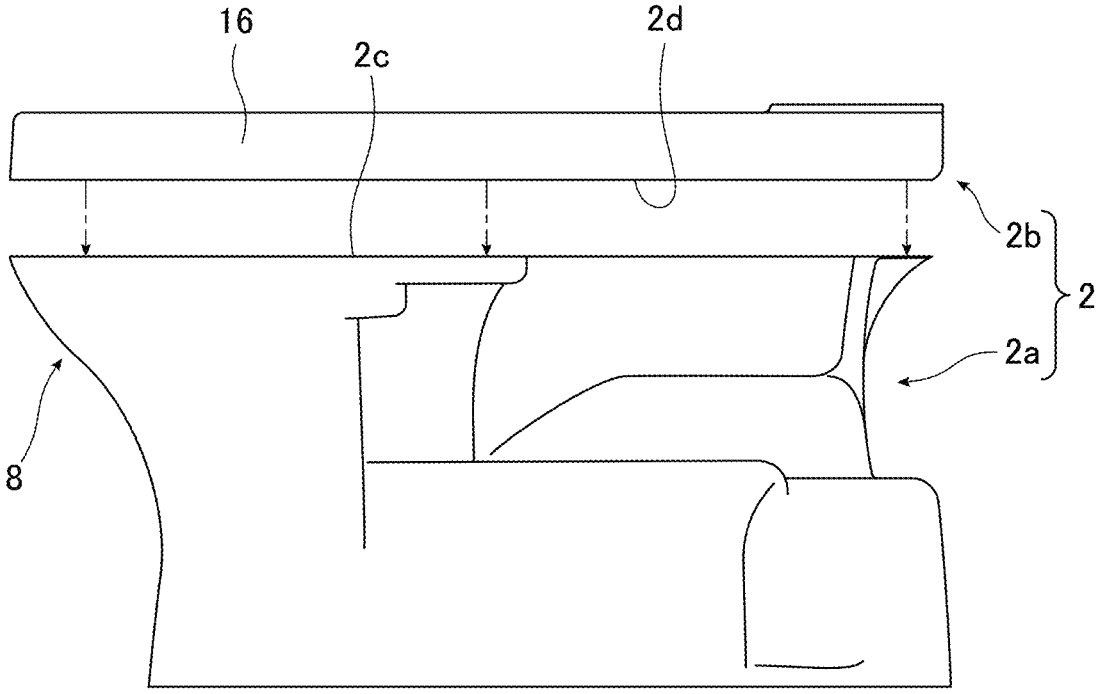
FIG. 12 is a side view showing the flush toilet main body prior to an adhesion step in a flush toilet according to an embodiment of the present invention.
Figure 13:
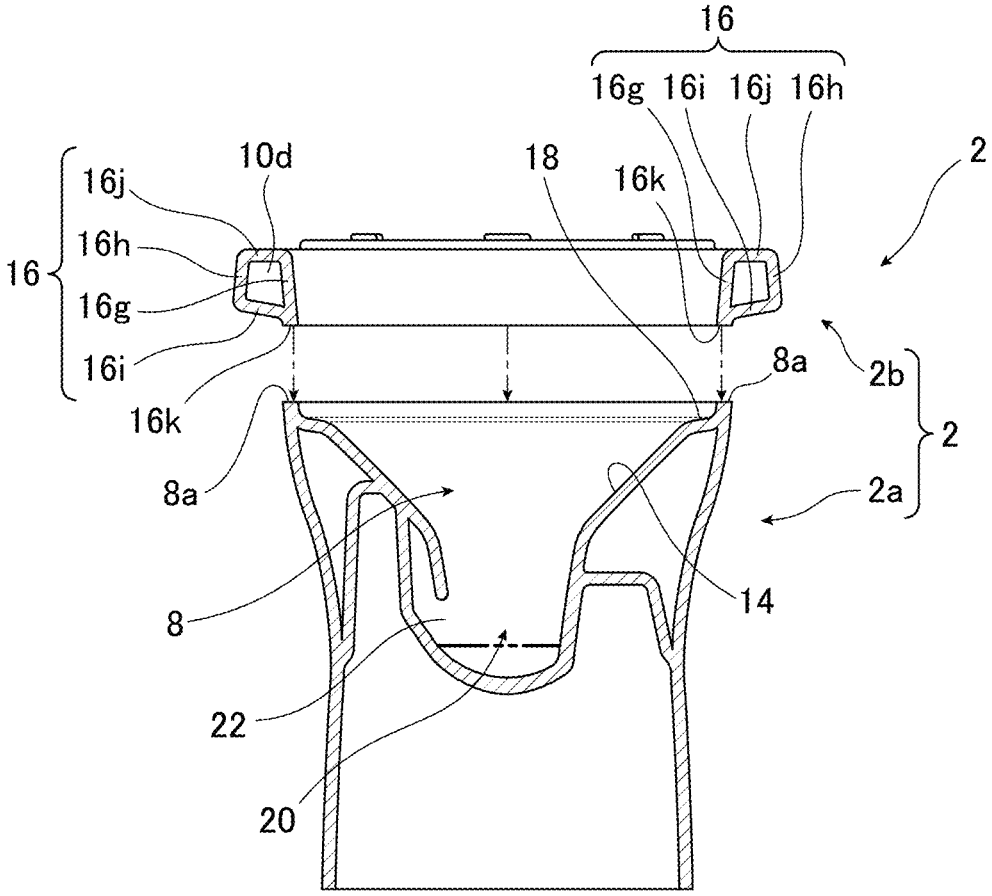
FIG. 13 is a front cross sectional view showing the flush toilet main body prior to an adhesion step in a flush toilet according to an embodiment of the present invention.

FIG. 12 is a side view showing the toilet main unit prior to the adhesive step in a flush toilet according to an embodiment of the present invention; FIG. 13 is a front cross sectional view showing the toilet main unit prior to the adhesive step in a flush toilet according to an embodiment of the present invention.

As shown in FIGS. 12 and 13, the ceramic toilet main unit 2 of the flush toilet 1 of the present embodiment is provided with a bottom toilet main unit 2*a* provided with a bowl portion 8 on which a waste receiving surface 14 and a shelf portion 18 are formed and from which a rim portion 16 is excluded, and a top side toilet main unit 2*b* provided with a rim portion 16, formed in advance separate from the bottom toilet main unit 2*a* at the time the toilet main unit 2 is manufactured, following which a bottom end portion 2*d* is adhered over the entire perimeter of the top end portion 2*c* of the bottom toilet main unit 2*a* in the adhesion step. This top side toilet main unit 2*b* is provided with a rim portion 16, which is adhered to the top end portion of the bowl portion 8 of the bottom toilet main unit 2*a*.

As shown in FIG. 13, the rim portion 16 of the top side toilet main unit 2*b* is provided with a rim inner wall portion 16*g* and a rim outer wall portion 16*h* respectively formed on the inner circumference and the outer circumference of the rim portion 16, a rim bottom surface portion 16*i* joining the two bottom end portions of the rim inner wall portion 16*g* and the rim outer wall portion 16*h*, and a rim top surface portion 16*j* joining the two top end portions of the rim inner wall portion 16*g* and the rim outer wall portion 16*h*, whereby the rim water conduit 10*d* is formed by the rim inner wall portion 16*g*, rim outer wall portion 16*h*, rim bottom surface portion 16*i*, and rim top surface portion 16*j*.

By thus utilizing the space formed by the rim inner wall portion 16*g*, rim outer wall portion 16*h*, rim bottom surface portion 16*i*, and rim top surface portion 16*j* as a rim water conduit 10*d*, there is no need to erect a separate water conduit, and a simple structure may be adopted for the toilet main unit 2. The structure is even further simplified by forming the rim spouting port 26 on the rim inner wall portion 16*g*, which is at a front position on the bowl portion 8.

Figure 6:
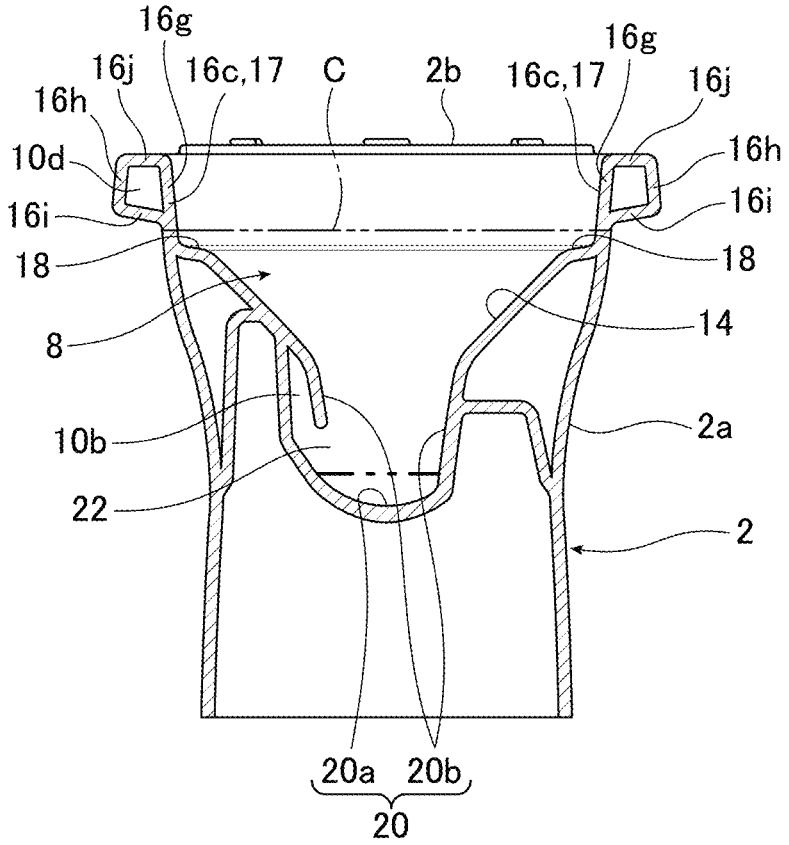
FIG. 6 is a cross sectional view seen along line VI-VI in FIG. 3.
Figure 7:
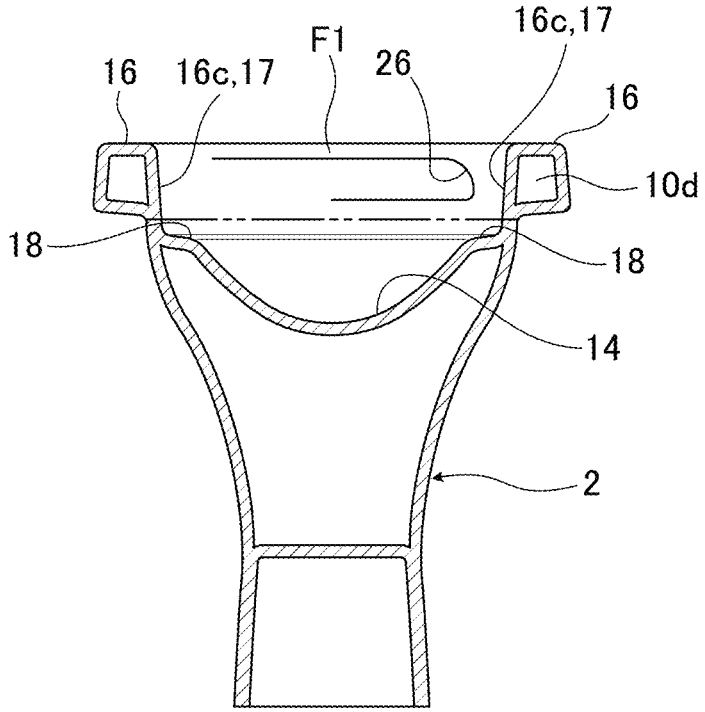
FIG. 7 is a cross sectional view seen along line VII-VII in FIG. 3.

In addition, FIGS. 6 and 10 show the toilet main unit 2 following the step in which the bottom toilet main unit 2*a* and the top side toilet main unit 2*b* are adhered, but the adhesion line C (border line) showing the adhesion portion between the bowl portion 8 part of bottom toilet main unit 2*a* excluding the rim portion 16 and the rim portion 16 of the top side toilet main unit 2*b* is positioned within the bottom region of the rim bottom surface portion 16*i* when seen in plan view from above. Therefore even if the adhesion line C, being the adhesion portion between the rim portion 16 and the bowl portion 8 excluding this rim portion 16, appears on the outer surface of the toilet main unit 2, this boundary line C is positioned within the bottom region of the rim bottom surface portion 16*i* when seen from above, and is therefore hidden by the rim bottom surface portion of the rim portion so that it cannot be seen, thereby improving the overall external aesthetic appeal of the toilet 1.

Also, as shown in FIGS. 6 and 13, with respect to the adhesion line C, being the adhesion portion between the bowl portion 8 in the bottom toilet main unit 2*a* and the rim portion 16 of the top side toilet main unit 2*b*, line contact between the top end portion 8*a* of the bowl portion 8 and the bottom end portion 16*k* of the rim inner wall portion 16*g* in the adhesion step forms a boundary line between the bowl portion 8 main unit and the rim portion 16, and this boundary line can be seen from the inside of the bowl portion 8 main unit and the rim portion 16. Thus when the rim portion 16 and the bowl portion 8 excluding the rim portion 16 are adhered at the time of manufacture of the toilet main unit 2, the boundary line (adhesion line C) formed by the line contact between the bottom end portion of the rim inner wall portion 16*g* and the top end portion 8*a* of the bowl portion 8 excluding the rim portion 16 is visible from inside the bowl portion 8, thereby facilitating the work of adhering the rim portion 16 and the bowl portion 8 excluding the rim portion 16 when the toilet main unit 2 is manufactured.

Next, referring to FIGS. 1 through 17, an operation of a flush toilet according to an embodiment of the present invention is described.

Figure 14:
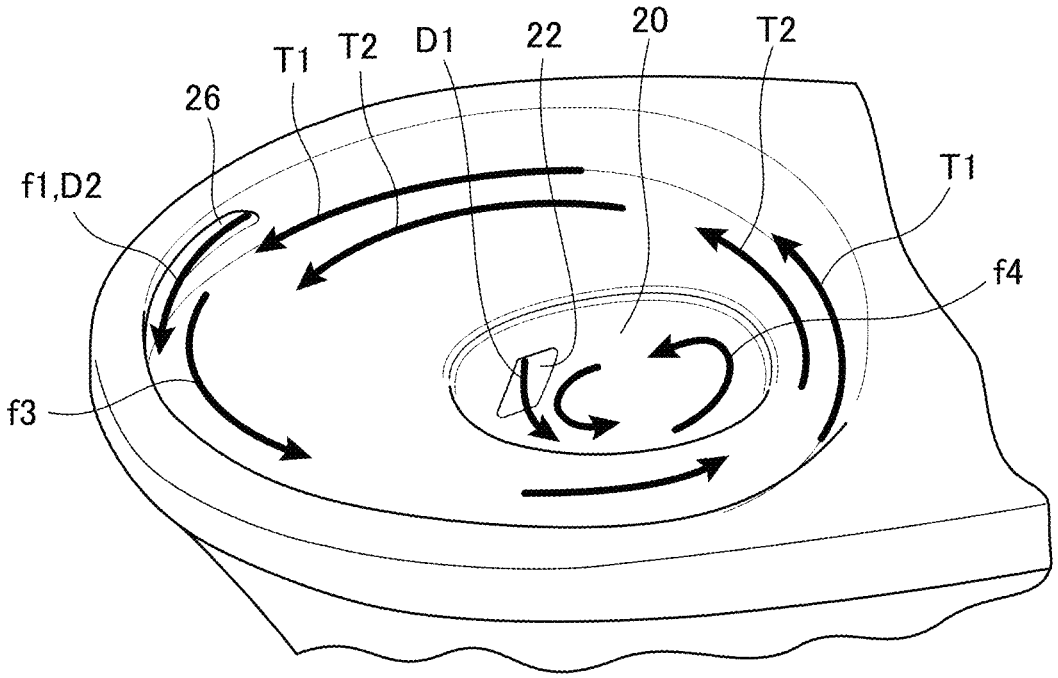
FIG. 14 is a perspective view explaining in schematic form the first circulation first swirl trajectory and the second circulation second swirl trajectory in the rim spout water when a rim cleaning is implemented after the start of jet cleaning of a flush toilet according to an embodiment of the present invention.

FIG. 14 is a perspective view explaining in schematic form the first circulation first trajectory and the second circulation second swirling trajectory by the rim spout water when a rim cleaning is implemented after the start of jet flushing in a flush toilet according to an embodiment of the present invention; FIG. 15 is a perspective view explaining in a schematic form the state whereby the swirling flow of rim spout water in a flush toilet according to an embodiment of the present invention flows downward into a concave portion.

First, toilet flushing is started when a user operates an operating lever (not shown) in order to flush the toilet, and flush water in the reservoir tank 6 flows through the shared water conduit 10*a*, branching into jet water conduit 10*b* and rim water conduit 10*d*. After spouting from the jet water spouting port 22 has started at the beginning, spouting from the rim spouting port 26 then begins at a delay. At this point, the water spouting direction D1 in the jet water spouting port 22 (arrow D1 in FIG. 14) is diagonally downward facing forward, and is essentially the same as the water spouting direction D2 in the rim spouting port 26 (arrow D2 in FIG. 14).

As shown in FIGS. 11 and 14, rim spout water spouted from the rim spouting port 26 flows to the front side along the inner circumferential surface of the rim portion 16, passes the vicinity of the front end portion 16*a* of the rim portion 16 where the curvature radius is smallest, and forms a flow (swirl flow f1) which swirls in a left rotation to the rear side of the rim portion 16, as well as forming a flow (falling flow f2) by which a part of the rim spout water falls down from the top end side of the rim portion 16. After the first circulation, rim spout water also forms a second circulation left rotation swirl flow f3 inside the first circulation swirl flow f1.

On the other hand, jet spouted water spouted diagonally downward toward the front (spouting direction D1) from the jet water spouting port 22 flows along the front side wall surface 20*b* and the bottom surface 20*a* on the front side within the concave portion 20, and after swirling as it rises diagonally upward from the bottom toward the rear side, forms a diagonal swirl flow f4, which swirls along the rear side wall surface 20*b* within the concave portion 20. This diagonal swirl flow f4 forms a left-rotation swirl flow when the concave portion 20 is seen in plan view from above; the swirl direction of the rim-spouted water and the swirl direction of the jet-spouted water are the same (left-rotating) when seen in plan view.

As shown in FIG. 14, the first swirl trajectory T1 at the time flush water spouted from the rim spouting port 26 is swirling in the first circulation swirl flow f1 along the rim portion 16 is positioned above and outside the second swirl trajectory T2 at the time of swirling by the second circulation swirl flow f3 along the rim portion 16 and shelf portion 18 after the first circulation swirl is ended in this first circulation first swirl trajectory T1.

Next, as shown in FIG. 14, rim spout water flows down within the concave portion 20 along the waste receiving surface 14 while for the most part maintaining its force in the direction of the left-rotating swirl flow; it then merges with the swirl flow of the jet spout water in the concave portion 20 and produces a diagonal swirl flow f4 with a comparatively strong and fast rotational force in the concave portion 20.

Figure 15:
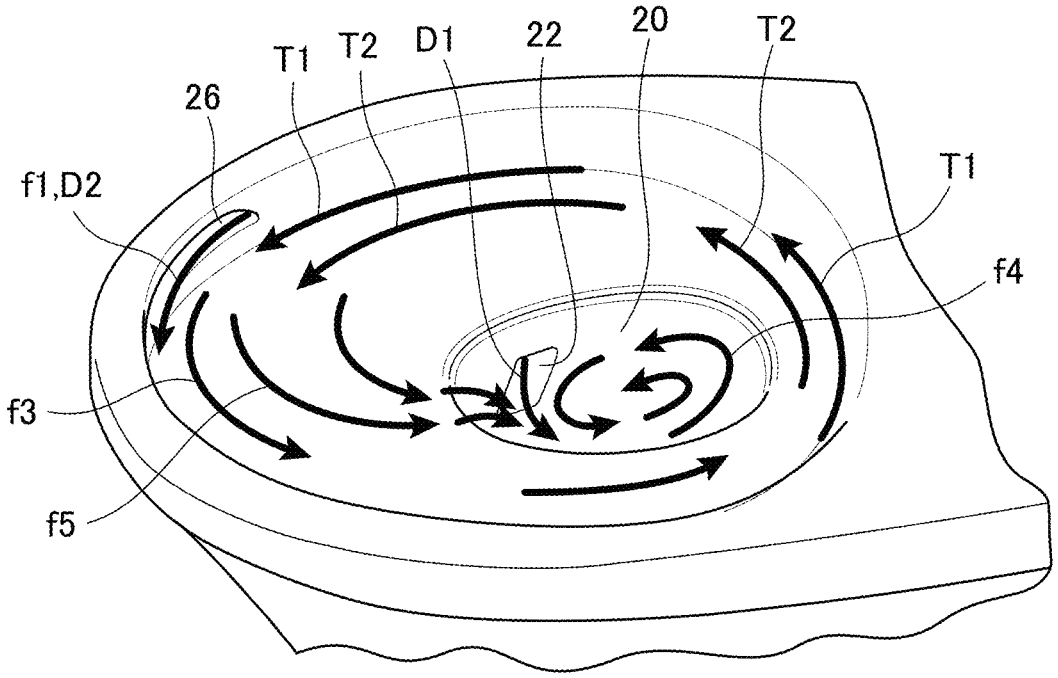
FIG. 15 is a perspective view explaining in a schematic manner the state whereby the swirling flow of rim spout water in a flush toilet according to an embodiment of the present invention flows downward into a concave portion.

Also, as shown in FIG. 15, new rim spouting continues to occur from the rim spouting port 26 after the rim spout water merges with the diagonal swirl flow f4 of the jet spouted water in the concave portion 20, and as the volume of rim spout water swirling on the waste receiving surface 14 increases, the swirl flow f5 of rim spout water at increased flow force flows down and merges toward the diagonal swirl flow f4 of jet spout water in the concave portion 20, forming a flow by which waste in the concave portion 20 is strongly pushed toward the inlet port 12*a* of the water discharge trap pipe 12.

Finally, the comparatively strong rotational force of the diagonal swirl flow f4 in the concave portion 20 after merging with the rim spout water enables high specific gravity waste to be pushed into the water discharge trap pipe 12 from the bowl portion 8, and enables low specific gravity floating waste to be sent into the water discharge trap pipe 12 from the bowl portion 8 by the comparatively fast post-merge rotating diagonal swirl flow f4.

Figure 16A:
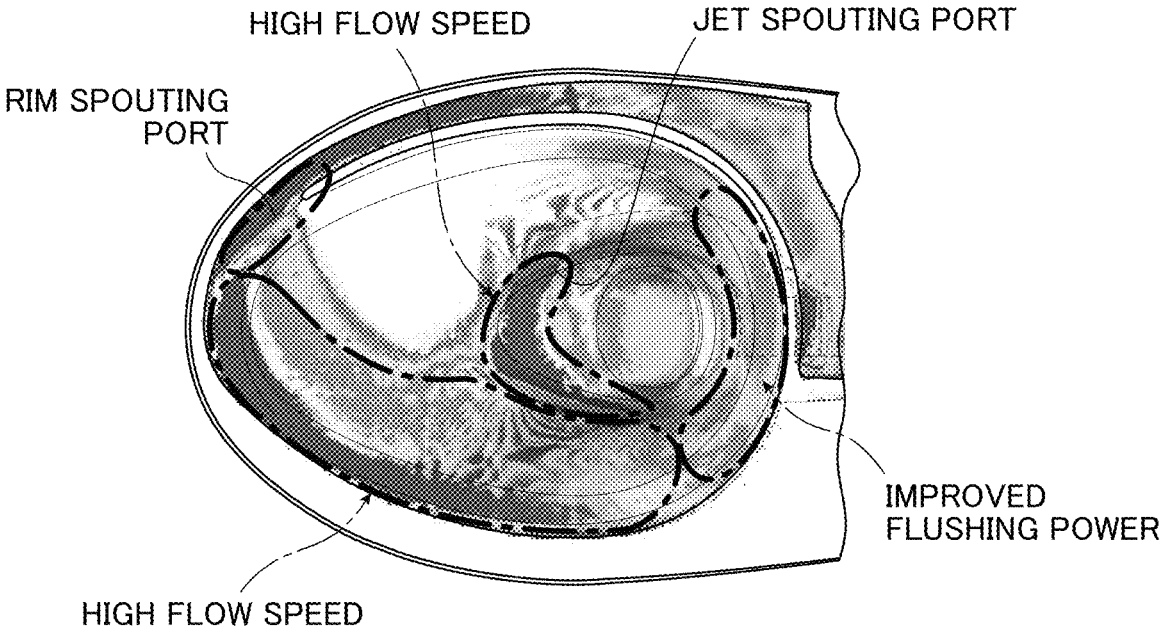
FIG. 16(*a*) is an example of the results of an analysis of the distribution of flow rates in the rim spout water and the jet spout water when a toilet is flushed using a flush toilet according to an embodiment of the present invention, and FIG. 16(*b*) shows the results of an analysis of flow rate distribution for rim spout water and jet spout water when a toilet is flushed using a conventional flush toilet, as a comparative example relative to the analytic results shown in FIG. 16(*a*)
Figure 16B:
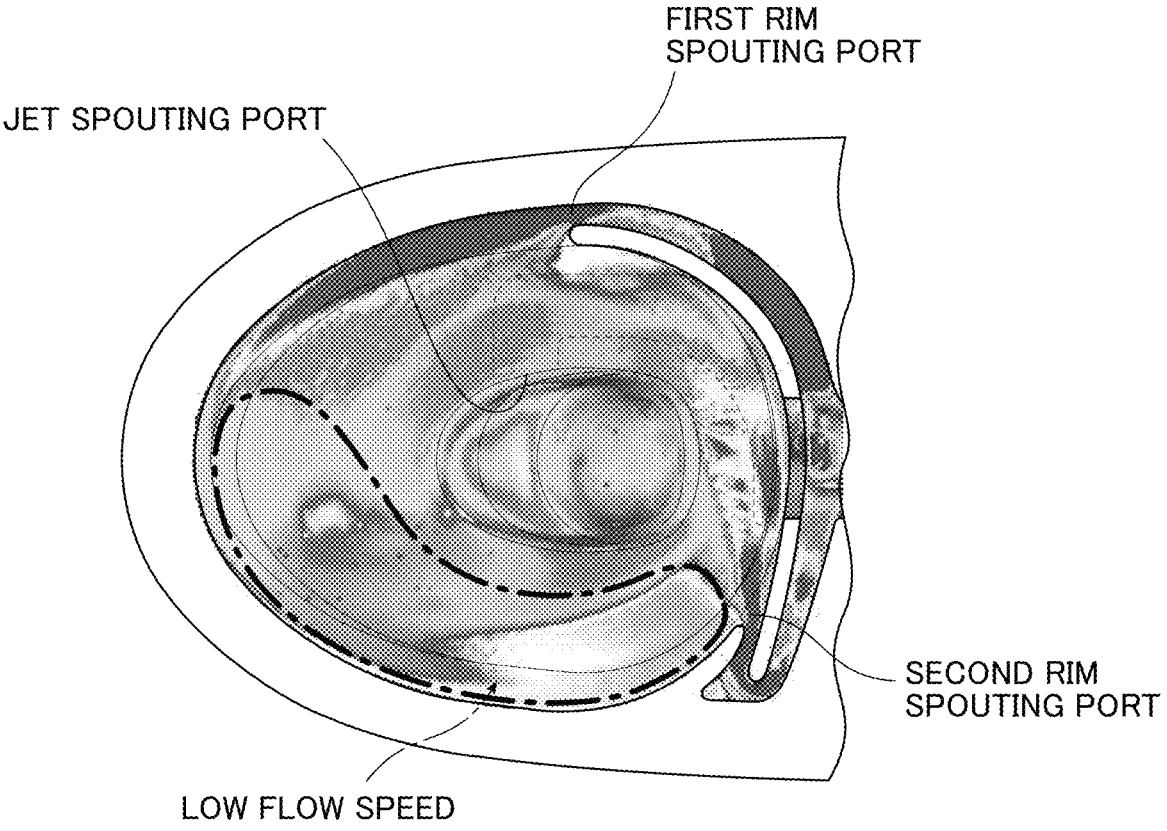

Next, FIG. 16(*a*) shows an example of the results of a flow speed distribution analysis of rim spout water and jet spout water when a toilet is flushed using a flush toilet according to an embodiment of the present invention; FIG. 16(*b*)

shows, as a comparative example relative to the analytic results shown in FIG. 16(*a*), the results of a flow speed distribution analysis of rim spout water and jet spout water when flushing a conventional toilet.

The shading of the flush water shown in FIG. 16 indicates the extent of the flush water flow speed; when the toilet main unit 2 of the flush toilet 1 in the above-described embodiment is seen from above, a comparatively large flush water flow speed is obtained from the rim spouting port in the bowl portion, passing the rim portion front end, up to the rear region in which it swirls in left rotation, and in the vicinity of the jet water spouting port of the concave portion and the region in front of same.

In contrast, the flush toilet in the comparative example shown in FIG. 16(*b*) differs from the form of the flush toilet 1 in the present embodiment, and is a form in which two rim spouting ports (first and second rim spouting ports) are provided in the region on the rear side of the rim portion, and a jet spouting port is provided on the side wall surface on one side of the concave portion within the bowl portion, but in the region from the rim portion front end in the bowl portion to the vicinity of the rear side second rim spouting port, the flow speed of the flush water is comparatively small compared to the flush toilet 1 of the present embodiment, so it is apparent that the flushing power of the flush toilet of the present embodiment is improved compared to a conventional flush toilet.

Figure 17A:
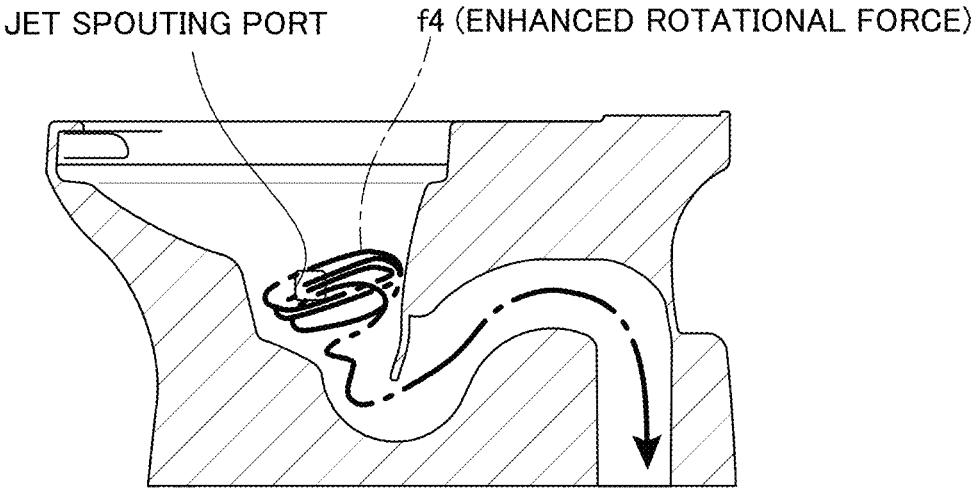
FIG. 17(*a*) is an example of the results of an analysis of the distribution of flow rates in the jet spout water and the appearance of the flow when a toilet is flushed using a flush toilet according to an embodiment of the present invention.
Figure 17B:
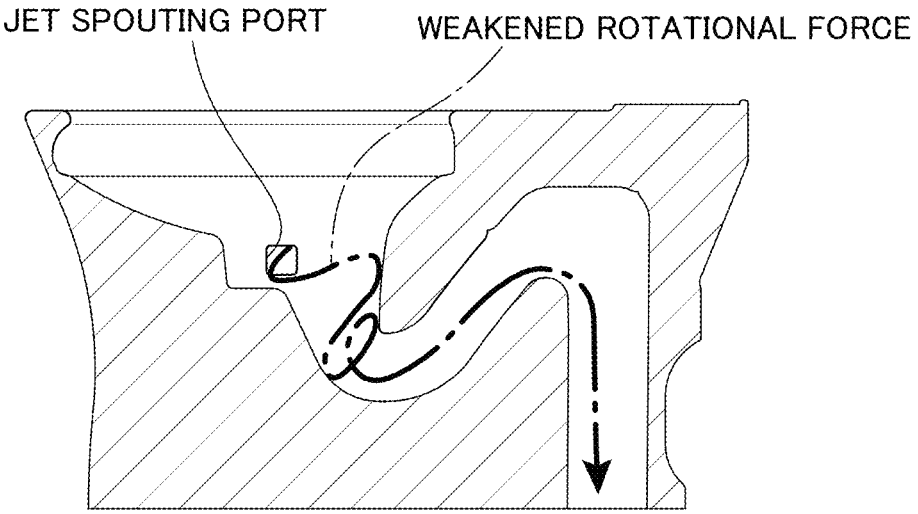

Next, FIG. 17(*a*) shows an example of the results of an analysis of flow speed distribution and the appearance of flow of jet spout water when a toilet is flushed using a flush toilet according to an embodiment of the present invention; FIG. 17(*b*) shows, as a comparative example relative to the analytic results shown in FIG. 17(*a*), the results of an analysis of jet flow water speed distribution and the appearance thereof when a toilet is flushed using a conventional flush toilet.

First, the shading of the flow lines in the flush water shown in FIG. 17(*a*) indicates the degree of flush water flow force, but it is apparent that when the toilet main unit 2 of the flush toilet 1 of the above-described present embodiment is viewed from the side, jet spout water spouted diagonally downward facing forward from the jet spouting port on the concave portion of the bowl portion flows along the front side wall surface and bottom surface in the concave portion, and swirls as it rises diagonally upward from below facing the rear side, after which it forms a diagonal swirl flow f4 which swirls along the wall surface on the rear side in the concave portion and diagonally downward.

In contrast, the flush toilet of the comparative example shown in FIG. 17(*b*) is of the same form as the flush toilet in the comparative example shown in FIG. 16(*b*), and the jet spout water spouted from the jet spouting port forms a flow which falls to the bottom surface of the concave portion after being spouted toward the side wall surface of the concave portion opposite the jet spouting port. Therefore the flow speed and rotational force of the swirl flow in the concave portion of the flush toilet of the comparative example is weakened and the flow pushing into the discharge trap pipe is reduced compared to the flow speed and rotational force of the strong diagonal swirl flow f4 in the front region F of the present embodiment shown in FIG. 17(*a*), making it apparent that waste discharge performance is improved in the flush toilet of the present embodiment compared to a conventional flush toilet.

In a flush toilet 1 according to an embodiment of the present invention, the rim spouting port 26 is formed on either the left side or the right side in the front region F of the rim portion 16 so that flush water is spouted toward the front, and after this spouted flush water passes from the front region F2 through the front end portion 16*a* in the front region F1, it swirls to the rear region R, therefore flush water possessing flow force spouted from the rim spouting port 26 first passes over the inner circumference side front end portion 16*a* of the small curvature radius rim portion 16, so that a situation can be prevented whereby flush water is unable to swirl in the front region F1 of the rim portion 16 in a way resulting in poor cleaning. Moreover, because flush water can maintain a comparatively strong flow force as it swirls to the rear region R of the rim portion 16, the easily dirtied rear region R of the bowl portion 8 can also be reliably cleaned.

Also, in the flush toilet 1 according to the present embodiment, the rim spouting port 26 is formed in the front region F2, which is to the rear of the front region F1 containing the inner circumference side front end portion 16*a* of the rim portion 16 formed at minimum curvature radius ρ1, therefore the water spouting direction vector and the water flow force of the flush water spouted from the rim spouting port 26 can be stabilized so that after passing over the inner circumference side front end portion 16*a* of the rim portion 16 while maintaining a comparatively high flow force, flush water can swirl to the rear region R of the rim portion 16. By so doing, the easily dirtied rear region R of the bowl portion 8 can be properly washed, and since the flush water continues to swirl with its flow force maintained after passing over the rear region R, the situation can be prevented whereby cleaning is poor due to an inability to also swirl in the vicinity of the rim portion 16 front end portion 16*a*. Since flush water can circulate up to the rear region R of the rim portion 16 while maintaining a comparatively strong flow force, the easily dirtied rear region R of the bowl portion 8 can also be reliably cleaned.

In addition, in the flush toilet 1 according to the present embodiment, the rim spouting port 26 is formed in the front region F2 of the rim portion 16 of the bowl portion 8 on a part which is adjacent to either the left or right of the inner circumference-side front end portion 16*a*, and which changes in curvature radius ρ2 from a large curvature radius to a small curvature radius, therefore flush water spouted from the rim spouting port 26 immediately reaches the inner circumference front end portion 16*a* on the rim portion 16 with a strong force maintained, after which it is able to swirl in the rear region R of the rim portion 16, thereby preventing a situation in which cleaning is poor because flush water cannot swirl in the inner circumference front end portion 16*a* of the rim portion 16 with minimum curvature radius ρ1. Since flush water can swirl to the rear region R of the rim portion 16 while sufficiently maintaining a comparatively strong flow force, the easily dirtied rear region R of the bowl portion 8 can also be reliably cleaned.

In the flush toilet 1 according to the present embodiment, the majority of the rear region R of the rim portion 16 of the bowl portion 8 forms a true circle having a predetermined radius (curvature radius ρ3), therefore since the curvature radius ρ3 (radius) does not change in the majority of the rear region R of the rim portion 16 of the bowl portion 8, loss of energy in the flush water passing through the rear region R of the rim portion 16 can be restrained, and flush water can be made to more reliably swirl. Since flush water can circulate up to the rear region R of the rim portion 16 while maintaining a comparatively strong flow force, the easily dirtied rear region R of the bowl portion 8 can also be reliably cleaned.

In addition, in the flush toilet 1 according to the present embodiment, the inner circumferential surface 17 of the rim portion 16 of the bowl portion 8 is formed into an inward facing overhang shape in the vicinity of the inner circumference side front end portion 16*a* of the rim portion 16, and is formed into a shape rising essentially vertically outside the vicinity of the inner circumference side front end portion 16*a* of the rim portion 16, so that splashing does not occur outside the toilet 1 in the vicinity of the inner circumference side front end portion 16*a* of the rim portion 16 of minimum curvature radius ρ1, therefore the flow force of flush water spouted from the rim spouting port 26 can be increased. As a result, situations in which flush water cannot swirl resulting in poor cleaning can be prevented in the vicinity of the inner circumference-side front end portion 16*a* of the rim portion 16 where the curvature radius is small. Since flush water can swirl to the rear region R of the rim portion 16, sufficiently maintaining a comparatively strong flow force, the easily dirtied rear region R of the bowl portion 8 can also be reliably cleaned. Moreover, since the inner circumferential surface 17 of the bowl portion 8 rim portion 16 is formed to rise approximately vertically in the region of the front end, any waste which should happen to adhere there can be easily removed, thereby improving sanitation.

Also, in the flush toilet 1 according to the present embodiment, the rim spouting port 26 is formed on the top end side of the rim portion 16 of the bowl portion 8, therefore flush water spouted from the rim spouting port 26 at the comparatively high position of the rim portion 16 forms a flow (swirl flow f1) which passes over the vicinity of the inner circumference side front end portion 16*a* of the small curvature radius rim portion 16 and swirls to the rear side of the rim portion 16 forming a flow (falling flow f2) falling from the top end side of the rim portion 16, therefore a broad region of the inner circumferential surface 17 of the overhang shape formed in the vicinity of the inner circumference side front end portion 16*a* of the rim portion 16 of the bowl portion 8 where dirt is prone to remain can be reliably cleaned by this swirl flow f1 and falling flow f2.

Also, in the flush toilet 1 according to the present embodiment, the top edge portion 26*b* of the rim spouting port 26 and the overhang-shaped part 16*b* of the inner circumferential surface 17 of the rim portion 16 are continuously formed, so flush water spouted from the rim spouting port 26 in a high position disposed on a higher end side of the rim portion flows smoothly along the inner circumferential surface 17 of the rim portion 16, and a swirl flow f1 and falling flow f2 passing the vicinity of the inner circumference side front end portion 16*a* of the rim portion 16 of the bowl portion 8 are formed, so that a broad region of the inner circumferential surface 17 of the overhang shape formed in the vicinity of the inner circumference side front end portion 16*a* of the rim portion 16 of the bowl portion 8 can be reliably cleaned.

Also, in the flush toilet 1 according to the present embodiment, the perimeter portion 26*d* of the rim spouting port 26 is inclined from bottom to top toward the water spouting direction, therefore flush water spouted from the rim spouting port 26 by means of the perimeter portion 26*d* inclined from bottom to top forms a flow (swirl flow f1) passing over the vicinity of the inner circumference side front end portion 16*a* of the small curvature radius rim portion 16 and swirls to the rear side of the rim portion 16, and forms a flow (falling flow f2) falling from the top end side of the rim portion, such that the vicinity of the inner circumference side front end portion 16*a* of the rim portion 16 of the bowl portion 8 can be reliably cleaned by this swirl flow f1 and falling flow f2.

Furthermore, in the flush toilet 1 according to the above-described embodiment of the present invention, flush water spouted toward the front from the rim spout port 26 in the front region F2 formed in the vicinity of the front end portion 16*a* inside the front region F1 of the rim portion 16 passes through the front end portion 16*a* in the front region F1 of the rim portion 16 and smoothly flows to the rear region R, in which curvature radius thereof is larger than curvature radius ρ1 of the front end portion 16*a* of the rim portion 16, maintaining the flow force of the spouted water; furthermore the rear region R of the rim portion 16 is formed to have a curvature radius ρ3 which is essentially fixed in left-right symmetry, therefore flush water can be circulated by taking advantage of centrifugal force acting on the flush water without reducing the force of the spouted water. As a result, flush water flowing in the rim portion 16 can be prevented from splashing outside the toilet 1, and a broad sweep of the bowl interior can be flushed with comparatively strong force, even when the inner circumferential surface 17 of the rim portion 16 is formed in an essentially vertically rising shape.

In the flush toilet 1 according to the present embodiment, the rim portion 16 of the bowl portion 8 is formed inside the front region F3 with a curvature radius ρ4 which is larger than the curvature radius ρ3 of the rear region R, therefore flush water spouted from the rim spout port 26 and passing through the front end portion 16*a* of the rim portion 16 flows in a state whereby it maintains comparatively strong flow force in the front region F2 closely adjacent to the front end portion 16*a* on the inner circumferential side within the front region F1 of the rim portion 16 of the bowl portion 8. By flowing through the front region F3 of the rim portion 16 formed with a curvature radius ρ4 larger than the curvature radius ρ3 of the rear region R of the rim portion 16, this flush water flows smoothly to the rear region R of the rim portion 16, maintaining in a stable state the flow force of the flush water from the rim portion 16 front region F1, so that even if the inner circumferential surface 17 of the rim portion 16 has a shape rising essentially vertically, splashing by flush water flowing in the rim portion 16 to outside of the flush toilet 1 can be prevented.

Furthermore, in the flush toilet 1 according to an embodiment of the present invention, flush water spouted at a strong flow force from the rim spout port 26 toward the front end portion 16*a* on the inner circumferential side within the front region F1 of the rim portion 16 is subjected to a moderate suppression of flow force due to a moderate loss of energy when passing through the front end portion 16*a* within the front region F1 of the rim portion 16 formed to the smallest curvature radius ρ1, therefore splashing of flush water outside of the flush toilet 1 caused by overstrong momentum can be prevented.

In addition, in the flush toilet 1 according to an embodiment of the present invention, the top edge portion of the part where splashing is particularly prone to occur, from the rim spout port 26 to the front end portion 16*a* within the front region F1 of the rim portion 16 provided with the smallest curvature radius ρ1, is furnished with an overhang portion 16*b* formed by an inwardly protruding overhang shape, therefore even if by some chance flush water swirling in the rim portion 16 splashes up in the part from the rim spout port 26 to the front end portion 16*a* within the front region F1 of the rim portion 16, this splash-up hits the overhang portion 16*b* of the rim portion 16, so that splashing outside the flush toilet 1 can be prevented.

Note that in the flush toilet 1 of the above-described embodiment, a flush toilet of the wash-down type is explained as an example, but the flush toilet may also be a siphon-type of flush toilet in which the siphon effect is utilized to draw in waste in the bowl portion and discharge it all at once from a discharge trap pipe.

Furthermore, in the flush toilet 1 of the above-described present embodiment, it is explained a form whereby jet spouting is performed using a jet water conduit 10*b* and a jet water spouting port 22, and rim spouting is performed using a rim water conduit 10*d* and a rim spouting port 26, but [the invention] is not limited thereto, and may also be applied to a form in which jet spouting by the jet water conduit 10*b* and the jet water spouting port 22 is omitted, and only rim spouting by the rim water conduit 10*d* and the rim spouting port 26 is performed.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet for discharging waste using flush water supplied from a flush water supply source, the flush toilet comprising:

a bowl portion including a bowl-shaped waste receiving surface, a rim portion formed on a top edge portion of the bowl portion, and a shelf portion formed between the rim portion and the waste receiving surface;

a water discharge path for discharging waste, the path including an inlet which is connected at a bottom of the bowl portion;

a water spouting portion for spouting flush water onto the shelf portion of the bowl portion to form a swirl flow, the water spouting portion consisting of a single water spouting port in an entire circumference of the rim portion; and a water conduit for supplying the flush water to the water spouting port of the water spouting portion;

wherein the bowl portion includes a front region which is a front side from a center line extending transversely located at a center equidistant from front and rear ends of the bowl portion and a rear region which is a rear side from the center line, and the rim portion of the bowl portion is such that a curvature radius of a front region of the rim portion in the front region of the bowl portion is smaller than a curvature radius of a rear region of the rim portion in the rear region of the bowl portion, wherein the water spouting port of the water spouting portion is formed on either a left side or a right side in the front region of the rim portion and spouts the flush water toward a front end of the rim portion so that the spouted flush water swirls from the front region of the rim portion via the front end of the rim portion to the rear region of the rim portion, wherein the rim portion has a first front region having an upstream end and a downstream end, the first front region including the front end of the rim portion and having a smallest constant curvature radius of an entire perimeter of the rim portion, and the water spouting portion is formed at an upstream side of the front end of the rim portion within the front region of the rim portion, and wherein the water spouting port extends to the upstream end of the first front region at a downstream end of the water spouting port.

2. The flush toilet according to claim 1, wherein the rim portion of the bowl portion is such that the inner circumferential surface of the rim portion is formed to have an inwardly overhanging shape in the vicinity of the front end of the rim portion, and is formed to have an approximately vertically rising shape outside the region of the front end of the rim portion.

3. The flush toilet according to claim 2, wherein the water spouting portion is formed on a top end side of the rim portion of the bowl portion.

4. The flush toilet according to claim 3, wherein a top surface of the water spouting port and the overhang-shaped portion of the inner circumferential surface of the rim portion are continuously formed.

5. The flush toilet according to claim 3, wherein the water spouting port of the water spouting portion is inclined from bottom to top toward the direction in which water is spouted.

6. A flush toilet for discharging waste using flush water supplied from a flush water supply source, the flush toilet comprising:

a bowl portion including a bowl-shaped waste receiving surface, a rim portion formed on a top edge portion of the bowl portion, an inner circumferential surface of which is formed to rise essentially vertically, and a shelf portion formed between the rim portion and the waste receiving surface;

a water discharge path for discharging waste, the path including an inlet which is connected at a bottom of the bowl portion;

a water spouting portion for spouting flush water onto the shelf portion of the bowl portion to form a swirl flow, the water spouting portion consisting of a single water spouting port in an entire circumference of the rim portion; and a water conduit for supplying the flush water to the water spouting port of the water spouting portion;

wherein the bowl portion includes a front region which is a front side from a center line extending transversely located at a center equidistant from front and rear ends of the bowl portion and a rear region which is a rear side from the center line, the water spouting port of the water spouting portion is formed within a front region of the rim portion in the vicinity of a front end in the front region of the bowl portion, and a rear region of the rim portion in the rear region of the bowl portion is formed to have a curvature radius larger than that of the front end of the front region of the rim portion and essentially fixed in left-right symmetry, wherein the water spouting port of the water spouting portion spouts water toward a front end of the rim portion so that the spouted flush water swirls from the front region of the rim portion via the front end of the rim portion to the rear region of the rim portion, wherein the rim portion has a first front region having an upstream end and a downstream end, the first front region including the front end of the rim portion and having a smallest constant curvature radius of an entire perimeter of the rim portion, and the water spouting portion is formed at an upstream side of the front end of the rim portion within the front region of the rim portion, and wherein the water spouting port extends to the upstream end of the first front region at a downstream end of the water spouting port.

7. The flush toilet according to claim 6, wherein the rim portion of the bowl portion is provided in the front region of the rim portion with a region proximate to the front end vicinity, formed to have a larger curvature radius than the curvature radius of the rear region of the rim portion.

8. The flush toilet according to claim 6, wherein the rim portion of the bowl portion is formed in an overhang shape in which a top edge portion of the rim portion protrudes inward in the part from the water spouting portion to the front end vicinity within the front region of the rim portion.

9. The flush toilet according to claim 1, wherein an entire circumference of the water spouting port is formed continuously with the inner circumferential surface of the rim portion.

10. The flush toilet according to claim 6, wherein an entire circumference of the water spouting port is formed continuously with the inner circumferential surface of the rim portion.

11. The flush toilet according to claim 1, wherein the water spouting portion is formed on the part which is adjacent to either the left side or the right side of the front end of the rim portion on the upstream side from the front end of the rim portion in the direction where the flush water is supplied such that the flush water spouted from the water spouting portion is directed to a part of the rim portion which has a smaller curvature radius than that of the part where the water spouting portion is formed.

12. The flush toilet according to claim 6, wherein the water spouting portion is formed on the part which is adjacent to either the left side or the right side of the front end of the rim portion on the upstream side from the front end of the rim portion in the direction where the flush water is supplied such that the flush water spouted from the water spouting portion is directed to a part of the rim portion which has a smaller curvature radius than that of the part where the water spouting portion is formed.

13. The flush toilet according to claim 1, wherein within the front region of the rim portion of the bowl portion, a curvature radius of an inner circumferential surface of the rim portion on an upstream side from the front end of the rim portion is larger than a curvature radius of the inner circumferential surface of the rim portion on a downstream side from the front end of the rim portion.

14. The flush toilet according to claim 6, within the front region of the rim portion of the bowl portion, a curvature radius of the inner circumferential surface of the rim portion on an upstream side from the front end of the rim portion is larger than a curvature radius of the inner circumferential surface of the rim portion on a downstream side from the front end of the rim portion.

* * * * *